US012389963B2

(12) United States Patent
Cronin et al.

(10) Patent No.: US 12,389,963 B2
(45) Date of Patent: Aug. 19, 2025

(54) HOOD

(71) Applicant: Amer Sports Canada Inc., North Vancouver (CA)

(72) Inventors: Ian Cronin, Vancouver (CA); Shera Yuk Ching Ng, Vancouver (CA)

(73) Assignee: Amer Sports Canada Inc., North Vancouver (CA)

( * ) Notice: Subject to any disclaimer, the term of this patent is extended or adjusted under 35 U.S.C. 154(b) by 0 days.

(21) Appl. No.: 18/112,017

(22) Filed: Feb. 21, 2023

(65) Prior Publication Data

US 2024/0122282 A1 Apr. 18, 2024

Related U.S. Application Data

(60) Provisional application No. 63/416,400, filed on Oct. 14, 2022.

(51) Int. Cl.
*A41D 31/06* (2019.01)

(52) U.S. Cl.
CPC ..... *A41D 31/06* (2019.02); *A41D 2200/20* (2013.01)

(58) Field of Classification Search
None
See application file for complete search history.

(56) References Cited

U.S. PATENT DOCUMENTS 4,573,217 A * 3/1986 Reed ..... A62B 17/04 2/205
5,072,454 A * 12/1991 Trahan ..... A62B 17/003 2/81
5,560,043 A 10/1996 Armstrong
6,397,395 B1 6/2002 DeHart
6,654,963 B2 * 12/2003 Fayle ..... A41D 3/00 2/84
6,874,162 B2 * 4/2005 Boezi ..... A41D 15/005 2/84
9,040,436 B2 * 5/2015 Johnson ..... B32B 5/08 442/79
9,301,556 B2 4/2016 Koeller et al.
10,238,157 B2 3/2019 Nordstrom
(Continued)

FOREIGN PATENT DOCUMENTS

CN 201805940 4/2011
CN 107692356 2/2018
(Continued)

OTHER PUBLICATIONS

Article entitled "Stormhood vs Drophood" posted by Canberk Koksal dated Oct. 31, 2022 on website https://outdoorcrunch.com/stormhood-vs-drophood/#:~:text=https%3A%2F%2Frei.com%2Fs,are%20sewn%20and%20move%20together.

*Primary Examiner* — Grace Huang
(74) *Attorney, Agent, or Firm* — Terence P. O'Brien; Todd A. Rathe

(57) ABSTRACT

A hooded garment may include a body portion having a neck opening, an outer hood projecting from the neck opening and having an outer face opening, and an inner hood projecting from the neck opening within the outer hood. The inner hood has an inner face opening facing in a forward direction. A lead is located rearward the inner face opening and extends from an exterior of the inner hood to an interior of the outer hood. A constrictor is connected to the inner hood to constrict the inner face opening without constricting the outer face opening.

21 Claims, 16 Drawing Sheets

(56) References Cited

U.S. PATENT DOCUMENTS

| | | | | |
|---|---|---|---|---|
| 10,251,439 | B2 | 4/2019 | Rolfe | |
| 10,455,878 | B2 * | 10/2019 | Rickle | F41H 3/00 |
| 10,537,144 | B1 * | 1/2020 | Suttman | A42B 3/048 |
| 10,827,789 | B2 | 11/2020 | Brensinger et al. | |
| 11,602,186 | B2 | 3/2023 | Baker | |
| 11,839,249 | B1 * | 12/2023 | Heberlein | A41D 1/00 |
| 2004/0187186 | A1 | 9/2004 | Boezi | |
| 2005/0160514 | A1 | 7/2005 | Flaniken | |
| 2007/0118960 | A1 * | 5/2007 | Goodwin | A41D 1/04 2/84 |
| 2011/0179548 | A1 * | 7/2011 | Weston | A41D 3/08 2/84 |
| 2016/0150847 | A1 * | 6/2016 | Johnson | A42C 5/04 2/202 |
| 2017/0265554 | A1 * | 9/2017 | Woodle | A42B 1/048 |
| 2019/0380403 | A1 * | 12/2019 | Schwirtz | A41D 1/06 |
| 2020/0093195 | A1 * | 3/2020 | Whitaker | A61F 9/045 |
| 2022/0015465 | A1 * | 1/2022 | Dickson | A41D 3/00 |
| 2022/0154650 | A1 | 5/2022 | Sheridan et al. | |
| 2022/0338576 | A1 | 10/2022 | Skurla, III | |

FOREIGN PATENT DOCUMENTS

| | | | | | |
|---|---|---|---|---|---|
| CN | 112493596 | | | 3/2021 | |
| EP | 1869988 | A1 | | 12/2007 | |
| GB | 2475509 | A | * | 5/2011 | A42B 1/048 |
| GB | 2496517 | | | 5/2013 | |
| JP | 2003201609 | A | * | 7/2003 | |
| KR | 20-0333648 | | | 11/2003 | |
| KR | 10-1482953 | | | 1/2015 | |

* cited by examiner

HOOD

CROSS REFERENCE TO RELATED APPLICATIONS

The present application is a non-provisional patent application claiming priority from U.S. Provisional Patent Application Ser. No. 63/416,400 filed on Oct. 14, 2022 entitled HOOD, the full disclosure which is hereby incorporated by reference.

BACKGROUND

Garments are frequently provided with hoods. Some hoods are provided to protect a person's head from the elements, such as wind, rain and snow. Some hoods are provided to insulate the person's head.

Figure 1:
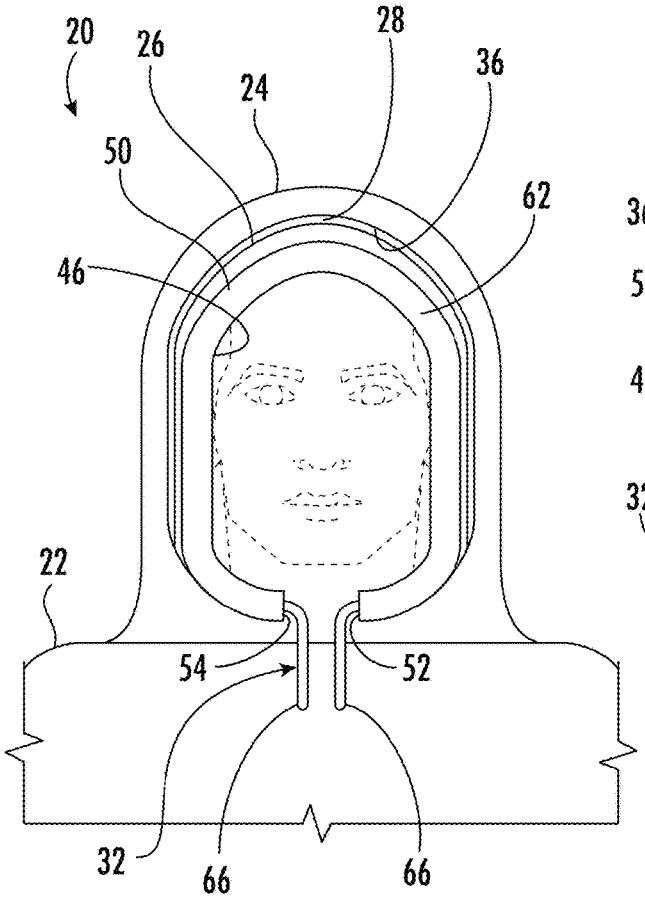
FIG. 1 is a front view schematically illustrating portions of an example hooded garment with an inner hood in an unconstricted state.

Throughout the drawings, identical reference numbers designate similar, but not necessarily identical, elements. The Figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example garments and associated hoods that include both an outer hood for protecting a wearer's head against weather elements and an inner hood for insulating the wearer's head. The inner hood has a face opening that may be constricted to enhance coziness and heat retention. The inner hood is connected to the outer hood to prevent their separation but is connected such that constriction of the face opening of the inner hood does not or is less likely to constrict or alter the shape of the outer hood. Constriction of the inner hood is less likely to wrinkle or bend the outer hood. As a result, rain impacting the outer hood is not directed towards the face of the person wearing the garment. The ability of the outer hood to direct weather elements, such as rain, away from the face opening of the inner hood is maintained.

In the examples illustrated, the inner hood is joined to the outer hood by an intervening lead. The inner hood has an inner brim portion that projects forwardly from the lead. The inner brim portion is provided with a constrictor forward the lead. The constrictor may be actuated to constrict the inner brim portion against the face of the person wearing the garment and to retain the inner brim portion in such a constricted state. Such constriction of the inner brim portion does not result in corresponding constriction of the outer hood. In some implementations, the outer hood may have an outer brim portion that extends over and above the inner brim portion. Constriction of the inner brim portion does not result in corresponding constriction of the outer brim portion.

In some implementations, the constrictor may comprise a sleeve extending along the inner brim portion and a drawstring slidably received within the sleeve. In some implementations, the constrictor may comprise a pair of cords or ropes attached to the inner hood, wherein the pair of cords or ropes may be drawn or pulled towards one another and tied to constrict the inner face opening of the hood about the face of the person wearing the garment and to retain the inner face opening in the constricted state. In some implementations, the constrictor may comprise a strap connected to a first portion of the inner hood proximate the inner face opening (such as below the chin of the person wearing the garment) and a buckle connected to another portion of the inner hood proximate the inner face opening, wherein the strap may be pulled through the buckle to tighten and constrict the inner face opening about the face of the person wearing the garment and wherein the buckle retains a strap to retain the inner face opening in the constricted state. In some implementations, the constrictor may comprise a first strap supporting one of a hook and loop fastener while being connected to a first portion of the inner hood proximate the inner face opening (such as below the chin of the person wearing the garment) and a second strap supporting the other of a hook and loop fastener or be connected to a second portion of the inner hood proximate the inner face opening, wherein the hook fastener and the loop fastener may be secured and retained to one another at a continuum of different relative positions while retaining the inner face opening in a constricted state about the face of the person wearing the hooded garment. In some implementations, the first or second strap may be omitted, wherein the hook or loop fastener is directly secured to the inner hood. In yet other implementations, the constrictor may have other configurations or mechanisms that facilitate constricting the inner face opening about the face of the person wearing the garment and retaining the inner face opening in the constricted state, without correspondingly constricting the outer face opening of the outer hood.

In some implementations, the inner hood and the outer hood have distinct stiffnesses or portions with distinct stiffnesses to facilitate shape retention of the outer hood during constriction of the inner hood. In some implementations, the outer hood has a rear portion extending rearwardly from the lead and an outer brim portion extending forwardly from the lead, wherein the outer brim portion has a greater stiffness, or resistance to bending, than the rear portion of the outer hood. In some implementations, the inner hood has an inner brim portion extending forwardly from the lead, wherein the outer brim portion of the outer hood has a greater bending stiffness than the bending stiffness of the inner brim portion.

In some implementations, the outer hood is formed from a stiff material such as an expanded polytetrafluoroethylene (ePTFE) material such as a stiff Gore-Tex™ material while the inner brim portion of the inner hood is formed of a flexible nylon material. In some implementations, the outer hood includes a Gore-Tex material wrapped about a stiffening panel, such as a nylon panel, laminated with an adhesive to produce a weather resistant outer brim of the outer hood. In some implementations, the outer hood includes multiple weather resistant panels that sandwich at least one material stiffening panel. In some implementations, a weather resistant panel of material is folded to form the outer brim portion of the outer hood, wherein the material stiffening panel is laminated within the fold. In some implementations, the outer hood has a bending stiffness that is at least twice as large as the bending stiffness of the inner hood. In some implementations, the outer brim portion has a bending stiffness that is at least 3 times as large as the bending stiffness of the inner brim portion. In some implementations, the outer hood has a bending stiffness that is at least 5 times as large as the bending stiffness of the inner hood.

In particular implementations, the lead and the inner hood are sized and shaped to provide a person with the ability to tightly constrict the face opening of the inner hood against the person's face without correspondingly changing the shape of the outer hood. In some implementations, the lead and the inner hood are shaped and sized to provide a person with the ability to tightly constrict the face opening of the inner hood against the person's face or against sides of the person's head without any change to the shape of the outer hood. In some implementations, the inner brim portion of the inner hood has a length of at least 2 inches. The lead has a length of at least 1 inch. The inner brim portion of the inner hood and the lead have a combined length of at least 0.5 inches and no greater than 6 inches.

In some implementations, the inner hood is further provided with a substantially horizontal sleeve through which an inner hood top constrictor extends. The inner hood top constrictor may be in the form of a drawstring which extend through the sleeve and through a rear opening in the inner hood, and further through a rear opening in the outer hood. Pulling of the drawstring may result in a top portion of the inner hood constricting about the front, sides and rear of the head received within the inner hood. The constriction extends along a path about the head similar to that of a headband. The drawstring forming the inner hood top constrictor may be retained in a constricted state or an unconstricted state with a cord lock. The inner hood top constrictor and the inner face opening constrictor are independently constricted to provide a customized fit of the inner hood while a top and sides of the outer hood do not correspondingly change in shape or size.

For purposes of this disclosure, the term "coupled" shall mean the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate member being attached to one another. Such joining may be permanent in nature or alternatively may be removable or releasable in nature.

For purposes of this disclosure, the phrase "configured to" denotes an actual state of configuration that fundamentally ties the stated function/use to the physical characteristics of the feature proceeding the phrase "configured to".

For purposes of this disclosure, the term "releasably" or "removably" with respect to an attachment or coupling of two structures means that the two structures may be repeatedly connected and disconnected to and from one another without material damage to either of the two structures or their functioning.

Figure 2:
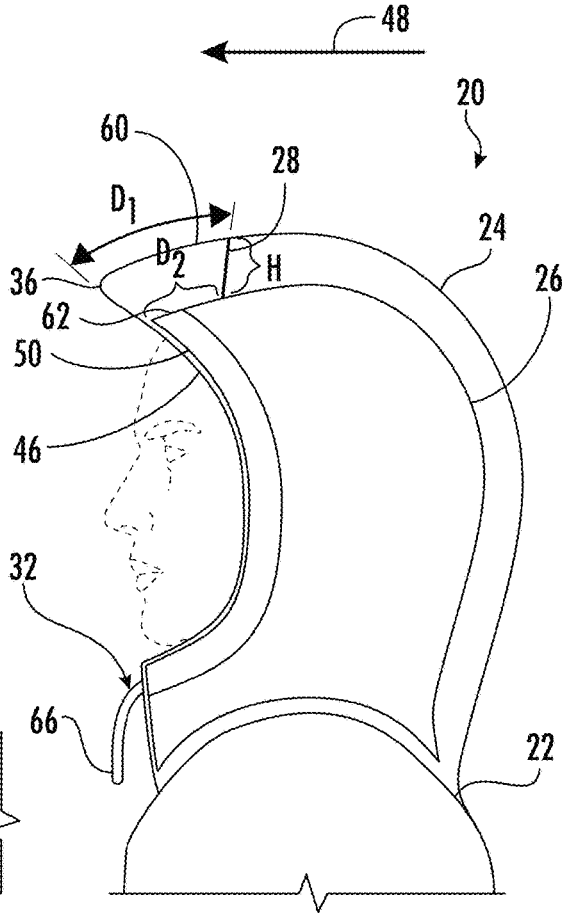
FIG. 2 is a side sectional view schematically illustrating portions of the example hooded garment of FIG. 1 with the inner hood in an unconstricted state.
Figure 3:
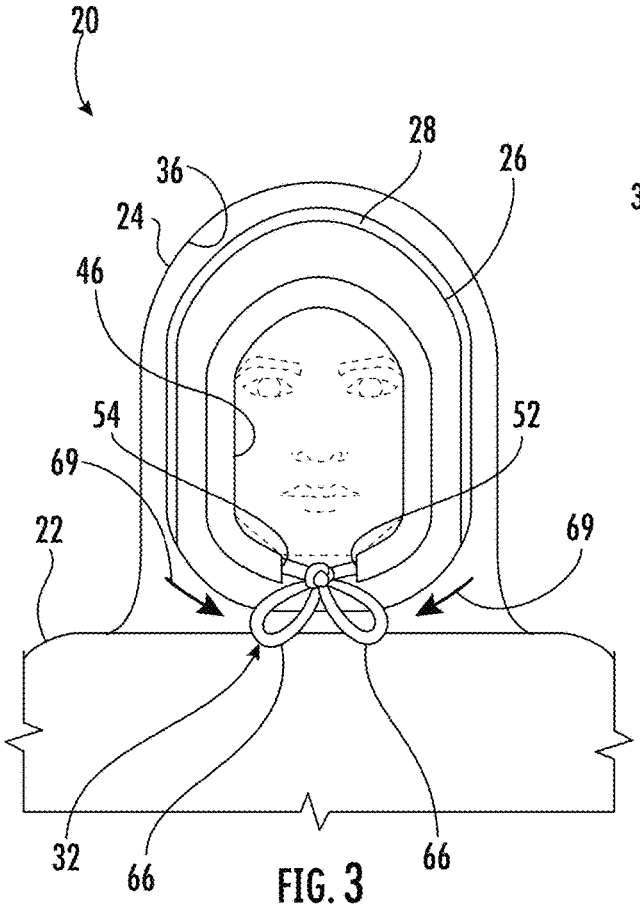
FIG. 3 is a front view schematically illustrating portions of the example hooded garment of 1 with the inner hood in a constricted state.
Figure 4:
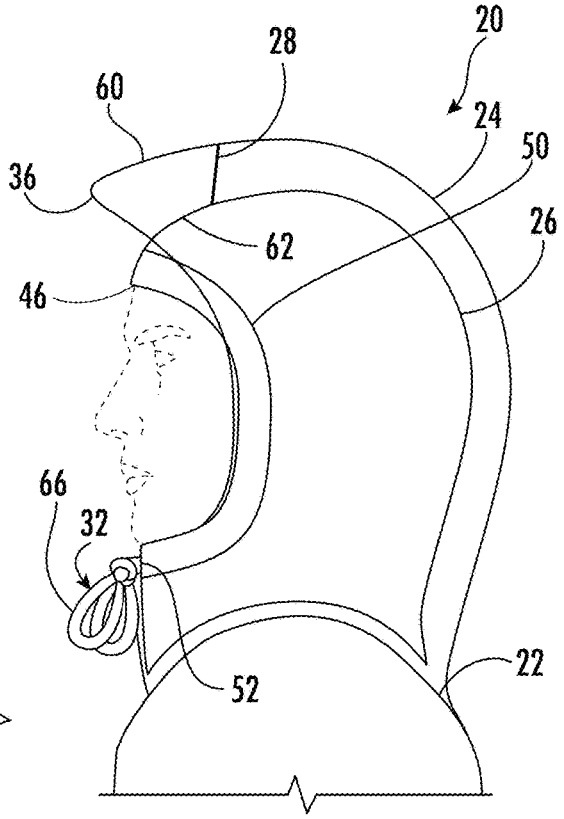
FIG. 4 is a side sectional view schematically illustrating portions of the example hooded garment of FIG. 3 with the inner hood in the constricted state.

FIGS. 1 and 2 illustrate portions of an example hooded garment 20 having an unconstricted inner hood. Garment 20 comprises body portion 22, outer hood 24, inner hood 26, lead 28 and inner face opening constrictor 32. Body portion 22 comprises that portion of garment 20 that may cover at least portions of a person's back and chest. In some implementations, body portion 22 may include sleeves for receiving a person's arms. In some implementations, such sleeves may be omitted. Body portion 22 comprises a neck opening for receiving a person's neck and from which a person's head may project when garment 20 is being worn. Body portion 22 may have various configurations with various layers. For example, body portion 22 may serve as a rain jacket. In some implementations, body portion 22 may be insulated to serve as a cold-weather or winter coat.

Outer hood 24 projects from body portion 22 and includes a face opening 36. Face opening 36 faces in a forward direction as indicated by arrow 48 and is located so as to at least partially expose the face of the person wearing garment 20. Outer hood 24 is configured to extend over and about the head of a person wearing the garment 20, covering the top, sides and rear of the head of the person wearing garment 20. In some implementations, outer hood 24 has an outer weather resistant surface, a surface that is formed from a material so as to offer resistance to penetration of wind and/or moisture, such as rain or snow. In some implementations, outer hood 24 may be formed from a material that is "breathable" yet is also weather resistant. For example, in some implementations, the outer surface of outer hood 24 may be formed from a Gore-Tex™ type material. In other implementations, outer hood 24 may be formed from other materials.

Inner hood 26 projects from body portion 22 within outer hood 24. Inner hood 26 comprises an inner face opening 46 that faces in a forward direction as indicated by arrow 48 in FIG. 2. Inner face opening 46 at least partially exposes the face of the person wearing garment 20. Inner hood 26 comprises a hem 50 which extends along the inner face opening 46.

In some implementations, hem 50 is formed from the same material forming the remainder of inner hood 26, but wherein hem 50 comprises a folded over portion of such material such that hem 50 has a greater overall thickness. In some implementations, hem 50 is formed from a band of inelastic fabric material stitching, bonded, with fused or otherwise joined to the edge of inner hood 26 along inner face opening 46. In some implementations, hem 50 is formed by an inelastic flexible cord, band or wire secured to inner hood 26 along the edges of inner face opening 46. For example, the wire or band may be contained within a sleeve formed by folding over portions of the layer or layers of material forming inner hood 26.

In some implementations, hem 50 may be elastic in nature. Hem 50 may be formed from one or more materials that enable hem 50 to be resiliently stretched. In some implementations, the entirety of inner hood 26 may be formed from material that is elastic. In some implementations, inner hood 26 may be inelastic but may be provided with an elastic cord or band that is secured to inner hood 26 along inner face opening 46. The elasticity of hem 50 may further facilitate enhanced conformance of inner face opening 46 to the face of the person wearing garment 20 when inner hood 26 is constricted.

In some implementations, the hem 50 may form a channel or tunnel for receiving a constrictor 32. The hem 50 may define first and second hem openings 52 and 54 at opposite ends of the hem. The constrictor 32 can extend along the entire length of the hem 50 and be configured to extend beyond one or both of the first and second hem openings. Hem 50 forms a flexible channel that is attached to the remainder of inner hood 26 and that extends about the face and head of the person wearing garment 20. Hem 50 is configured to be pulled by constrictor 32 into a constricted state against and about the face of the person wearing garment 20. Such constriction creates a more airtight relationship between the person's head and inner hood 26, providing enhanced heat retention. The constrictor 32 can be one or more cords, strings, cables or other elongated member. The constrictor 32 may be inelastic or can have varying degrees of elasticity.

In the example illustrated, inner face opening 46 of inner hood 26 is rearwardly recessed with respect to face opening 36 about hood 24. In the example illustrated, the top forward edge of outer face opening 36 of outer hood 24 extends forward (as indicated by arrow 48) and beyond of the top forward edge of inner face opening 46 of inner hood 26. As a result, outer hood 24 may better deflect or redirect downwardly moving moisture (rain or snow) away from inner face opening 46 and the face of the person wearing garment 20. In some implementations, outer hood 24 may project forward of a top of inner face opening 46 by at least 1 inch. In other implementations by more than a dimension that is greater than 1 inch. In other implementations, the top of inner face opening 36 and the top of outer face opening 46 may be coextensive or vertically aligned.

Lead 28 (schematically illustrated) comprises a layer or band of material that connects an exterior of inner hood 26 to an interior of outer hood 24 at a single location or multiple locations above body portion 22 and rearward of inner face opening 46 of inner hood 26. Lead 28 inhibits or restricts the entirety of outer hood 24 from being moved or pulled off of the head of the person wearing garment 20 without inner hood 26 also being moved or pulled off of the head of the person wearing garment 20. Lead 28 assists in retaining outer hood 24 about the head of the person wearing garment 20. Because inner hood 26 more closely fits about the head of the person wearing garment 20, it is less likely to be accidentally pulled back or off of the head of the person wearing garment 20. Because outer hood 24 is connected to inner hood 26, outer hood 24 is better retained on the head of the person wearing garment 20.

In some implementations lead 28 comprises a thin layer or band of material extending between inner hood 26 and outer hood 24. In some implementations, lead 28 comprises a continuous elongate panel extending parallel to and/or along a majority of the inner face opening 46, but rearward of the inner face opening 46, wherein the panel faces in a forward direction (as indicated by arrow 48). In some implementations, lead 28 comprises a single panel or multiple spaced panels extending between inner hood 26 and outer hood 24, wherein the panel or such multiple panels each face in a sideways direction (horizontal and perpendicular to arrow 48) and wherein the forward most edge of the panel or such panels are secured or joined to inner hood 26 at a location or locations rearward of inner face opening 46.

In some implementations, lead 28 is inelastic. In other implementations, lead 28 is elastic or resilient stretchable. For example, in some implementations, the overall structure of outer hood 24 may be sufficiently rigid or stiff such that lead 28 may be resiliently stretched to accommodate a desired degree of constriction of inner hood 26 while the shape and size of outer hood 24 is maintained.

The upper and lower end of lead 28 may be joined to outer hood 24 and to an outer brim portion of the inner hood 26 in various fashions. In some implementations, such ends may be secured by stitching, adhesive, welding, bonding, or combinations thereof. For example, in some implementations, the top portion or end of lead 28 may be secured to outer hood 24 by a glue, lamination or adhesive while the lower end of lead 28 may be secured to inner hood 26 by stitching. In some implementations, lead 28 may be integrally formed as a single unitary body with a material panel forming a portion of outer hood 24 and/or a material panel forming portions of inner hood 26.

In some implementations, lead 28 may have a height H of at least 0.25 inch. In other implementations, the lead 28 can have a height H within the range of 0.25 to 2.0 inches. In some implementations, lead 28 may be connected to outer hood 24 at a distance D1 of at least 1 inch rearward of the forward most point of outer face opening 36. In other implementations, the distance D1 can have a dimension within the range of 0.5 to 6 inches. In other implementations, the distance D1 can be within the range of 2.5 to 4 inches. In some implementations, lead 28 may be connected to inner hood 26 at a distance D2 of at least 1 inch rearward of the forward most point of inner face opening 46. In some implementations, the distance D2 can be within the range of 1 to 4 inches. In some implementations, the distance D1 is greater than or equal to distance D2. In some implementations, the height H of lead 28, and the length of the portion of inner hood 26 extending forward of lead 28, distance D2, have a combined length of at least 1.0 inches and no greater than 5 inches. In one implementation, the distance D1 is approximately 3 inches, the height H is approximately 1 inch and the distance D2 is approximately 2 inches. In some implementations, combined length of the height H of lead 28 and the length of the portion of inner hood 26, D2, extending forward of lead 28 have a combined length of at least 1.0 inches and no greater than 5.0 inches. In some implementations, combined length of the height H of lead 28 and the length of the portion of inner hood 26, D2, extending forward of lead 28 have a combined length within the range of 1.5 to 3.5 inches. As will be described hereafter, this combined length impacts the ability of those portions of inner hood 26 along inner face opening 46 to be constricted without corresponding constriction of outer hood 24.

Inner face opening constrictor 32 comprises a mechanism by which the inner face opening 46 of inner hood 26 may be constricted or tightened about and against the face or head of the person wearing garment 20. In the example illustrated, outer hood 24 comprises outer brim portion 60 that extends forwardly (in the direction indicated by arrow 48) from lead 28 and which terminates at the forward edge of outer face opening 36. Inner hood 26 comprises an inner brim portion 62 that extends forwardly from lead 28 and which terminates at the forward edge of inner face opening 46. Inner face opening constrictor 32 comprises a mechanism that is configured to constrict inner brim portion 62 about and against the face of the person wearing garment 20 without corresponding constriction of outer brim portion 60.

In the example illustrated, outer brim portion 60 overhangs and extends forwardly beyond inner brim portion 62. Outer brim portion 60 has a bending stiffness, or a resistance to bending, that is greater than the bending stiffness, or resistance to bending, of inner brim portion 62. In other words, outer brim portion 60 is less likely to bend or wrinkle and is more likely to retain a shape as compared to inner brim portion 62 when experiencing the same forces. For example, the outer brim portion 60 generally retains its shape in adverse weather conditions. At the same time, inner brim portion 62 may be more easily bend, deformed or constricted about the face or head of the person wearing garment 20. In some implementations, outer brim portion 60 has a bending stiffness that is at least 5 times as large as, or at least 5 times greater than, the bending stiffness of inner brim portion 62. In some implementations, outer brim portion 60 has a bending stiffness that is at least 6 times as large as, or at least 6 times greater than, the bending stiffness of inner brim portion 62. In some implementations, outer brim portion 60 has a bending stiffness that is at least 8 times as large as, or at least 8 times greater than, the bending stiffness of inner brim portion 62. The degrees of bending stiffness and the relative degree of bending stiffness between outer hood 24 and inner hood 26 impact the ability of constrictor 32 to constrict inner brim portion 62 without correspondingly constricting outer brim portion 60.

In the example illustrated, constrictor 32 comprises one or more tie lines 66, in the form of one or more straps, cords, ropes, strings or the like, that extend through one or more of the first and second hem ends 52 and 54 at opposite ends of the hem. As shown by FIGS. 1-4, in one implementation the constrictor 32 can take the form of a pair of tie lines 66 that can be secured to the hem ends 52 and 54, and may be pulled towards one another (in direction indicated by arrows 69) to pull hem 50 about and into closer conformity with the face and head of the person wearing garment 20. During pulling of tie lines 66, the forces are transmitted to hem 50, deforming or bending the shape of hem 50 towards and/or against the face or head of the person wearing garment 20. In those implementations where hem 50 is elastic, such forces may additionally resiliently stretch hem 50. Once inner face opening In the example illustrated, constrictor 32 comprises one or more tie lines 66, in the form of one or more straps, cords, ropes, strings or the like, that extend through one or more of the first and second hem ends 52 and 54 at opposite ends of the hem. As shown by FIGS. 1-4, in one implementation the constrictor 32 can take the form of a pair of tie lines 66 that can be secured to the hem ends 52 and 54, and may be pulled towards one another (in direction indicated by arrows 69) to pull hem 50 about and into closer conformity with the face and head of the person wearing garment 20. During pulling of tie lines 66, the forces are transmitted to hem 50, deforming or bending the shape of hem 50 towards and/or against the face or head of the person wearing garment 20. In those implementations where hem 50 is elastic, such forces may additionally resiliently stretch hem 50. Once inner face opening 46 has been constricted towards and possibly against the face of the person wearing garment 20, inner face opening 46 may be retained in the constricted state shown in FIGS. 3 and 4 by tying the tie strings 66 or otherwise retaining the drawn-in positioning of the tie strings 66.

Figure 5:
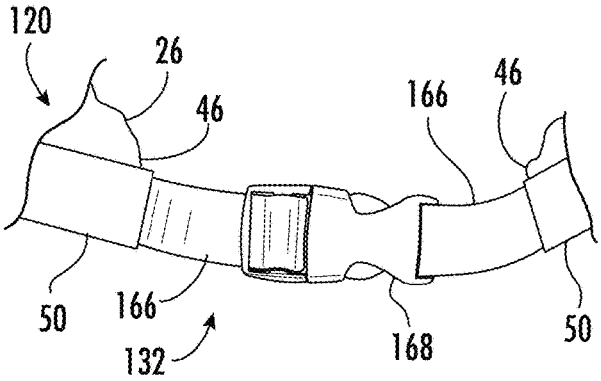
FIG. 5 is a fragmentary front view schematically illustrating portions of an example hooded garment with an inner hood retained in a constricted state.
Figure 6:
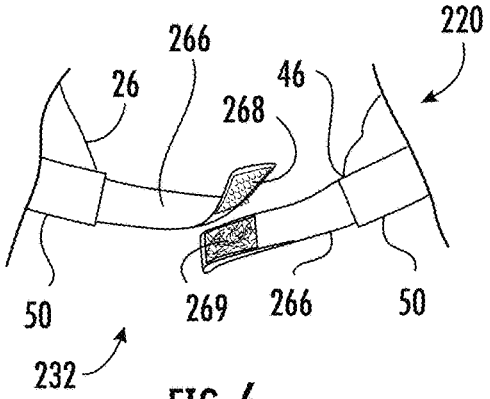
FIG. 6 is a fragmentary front view schematically illustrating portions of an example hooded garment with an inner hood retained in a constricted state.

FIGS. 5 and 6 illustrate alternative mechanisms for retaining the hem 50 and the inner face opening 46 in a constricted state. FIG. 5 illustrates an example garment 120 comprising constrictor 132 in place of constrictor 32. Those remaining components of garment 120 which correspond to components of garment 20 are numbered similarly and/or are shown in FIGS. 1-4.

Constrictor 132 comprises a pair of straps 166 that extend from and that are connected to opposite end portions of hem 50. Similar to tie lines 66, straps 166 may be pulled towards one another to pull hem 50 about and into closer conformity with the face and head of the person wearing garment 20. Constrictor 132 further comprises a buckle device 168 through which at least one of straps 166 extends. At least portions of straps 166 may be pulled through the buckle device 168, wherein the buckle device releasably grips the straps 166 to retain the state of the strap 166 and to retain hem 50 and inner face opening 46 in a constricted state. In some implementations, buckle device 160 may comprise a cam buckle, a ratchet buckle, side release buckle, slide buckle, snap buckle, tie buckle or the like.

FIG. 6 illustrates an example garment 220 comprising constrictor 232 in place of constrictor 32. Those remaining components of garment 220 which correspond to components of garment 20 are numbered similarly and/or are shown in FIGS. 1-4.

Constrictor 232 comprises a hook and loop (VELCRO™) attachment mechanism. In the example illustrated, constrictor 232 comprises a pair of straps 266 that extend from and that are connected to opposite end portions of hem 50. Similar to tie lines 66, straps 266 may be pulled towards one another to pull hem 50 about and into closer conformity with the face and head of the person wearing garment 20. Constrictor 232 further comprises hook fastener 268 and a loop fastener 269 supported by the two different straps 266. In some implementations, the hook fastener 268 and the loop fasting 269 may be secured and retained to one another at a continuum of different relative positions while retaining the inner face opening 46 in a constricted state about the face of the person wearing the garment. In some implementations, the first and/or second strap 266 may be omitted, wherein the hook and/or loop fastener is directly secured to the inner hood 26. In yet other implementations, the constrictor of garment 20 may have other configurations or mechanisms that facilitate constricting the inner face opening 46 about the face of the person wearing the garment 20 and retaining the inner face opening 46 in the constricted state, without correspondingly constricting the outer face opening 36 of the outer hood 24.

Figure 7:
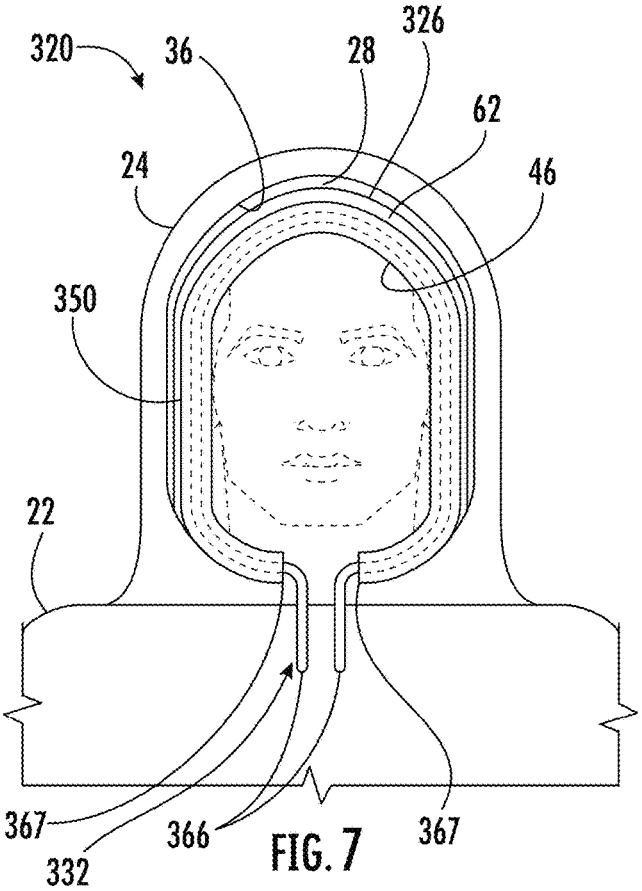
FIG. 7 is a front view schematically illustrating portions of an example hooded garment with an inner hood in an unconstricted state.
Figure 8:
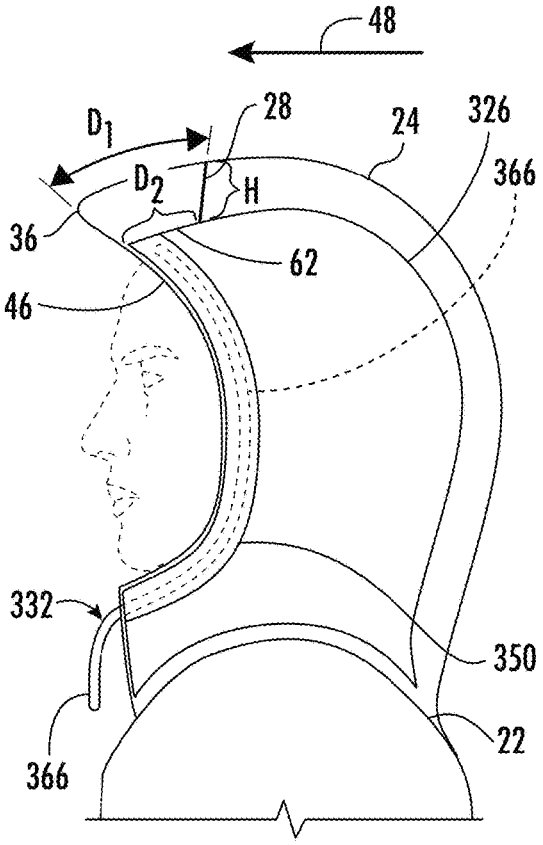
FIG. 8 is a side sectional view schematically illustrating portions of the example hooded garment of FIG. 7 with the inner hood in an unconstricted state.

FIGS. 7 and 8 illustrate portions of an example hooded garment 320 having an unconstricted inner hood. FIGS. 7 and 8 illustrate an example of an alternative constrictor for selectively constricting the inner face opening of an inner hood without correspondingly constricting an outer hood. Garment 320 is similar to garment 20 described above except that garment 320 comprises inner hood 326 and constrictor 332 in place of inner hood 26 and constrictor 32, respectively. Those remaining components of hooded garment 320 which correspond to components of hooded garment 20 are numbered similarly and/or are shown and described above with respect to hooded garment 20.

Inner hood 326 is similar to inner hood 26 described above except that inner hood 326 comprises sleeve 350 in place of hem 50. Sleeve 350 comprise a tube which extends along the inner face opening 46. Sleeve 350 guides and slidably receives constrictor 332 which is in the form of a drawstring 366. Although illustrated as a continuous, uninterrupted sleeve, sleeve 350 may alternatively comprise a series of spaced sleeves along inner face opening 46 and through which drawstring 366 extends. In some implementations, sleeve 350 forms the edge of the inner face opening 46. In some implementations, sleeve 350 extends slightly rearward of the forward edge of inner face opening 46. Although sleeve 350 is illustrated as having drawstring openings 367 proximate to the top of body portion 22, at the lower end of face opening 46, in other implementations, sleeve 350 may have drawstring openings 367 at other locations, such as higher up along inner face opening 46 or further down at locations on body portion 22.

Figure 9:
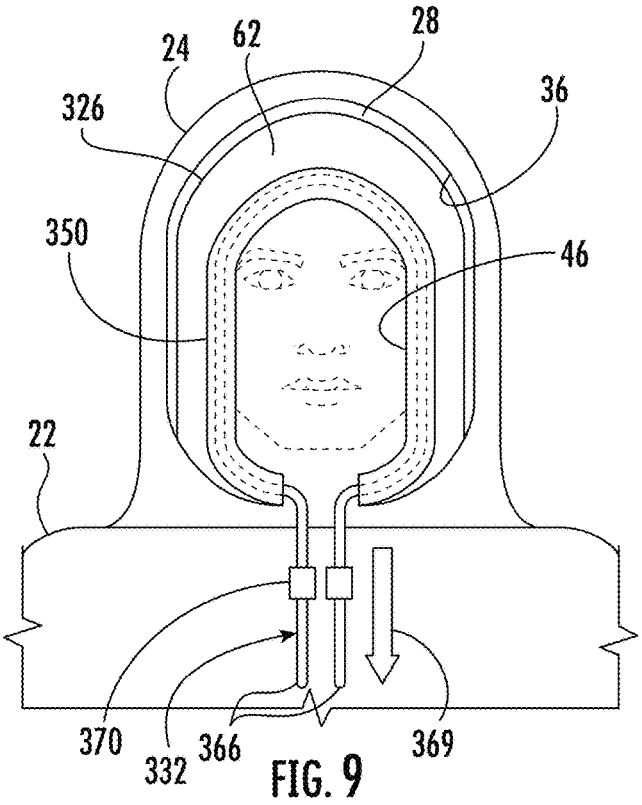
FIG. 9 is a front view schematically illustrating portions of the example hooded garment of FIG. 7 with the inner hood in a constricted state.
Figure 10:
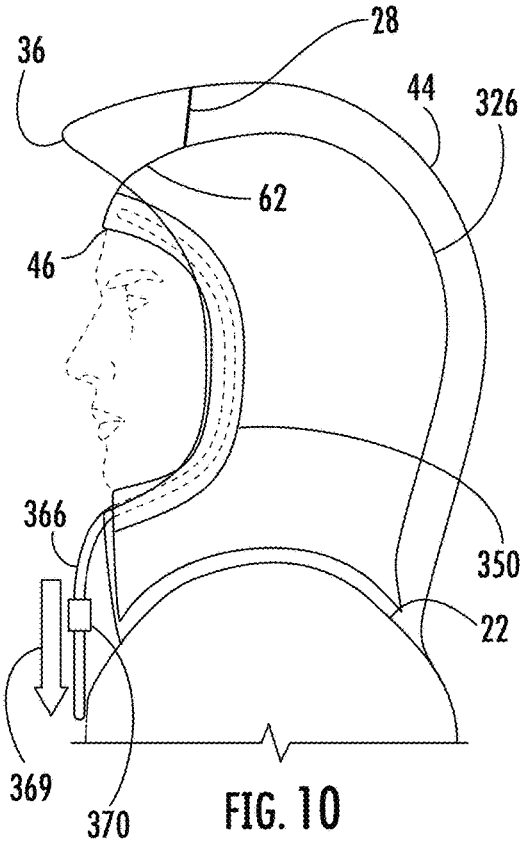
FIG. 10 is a side sectional view schematically illustrating portions of the example hooded garment of FIG. 9 with the inner hood in the constricted state.
Figure 11:
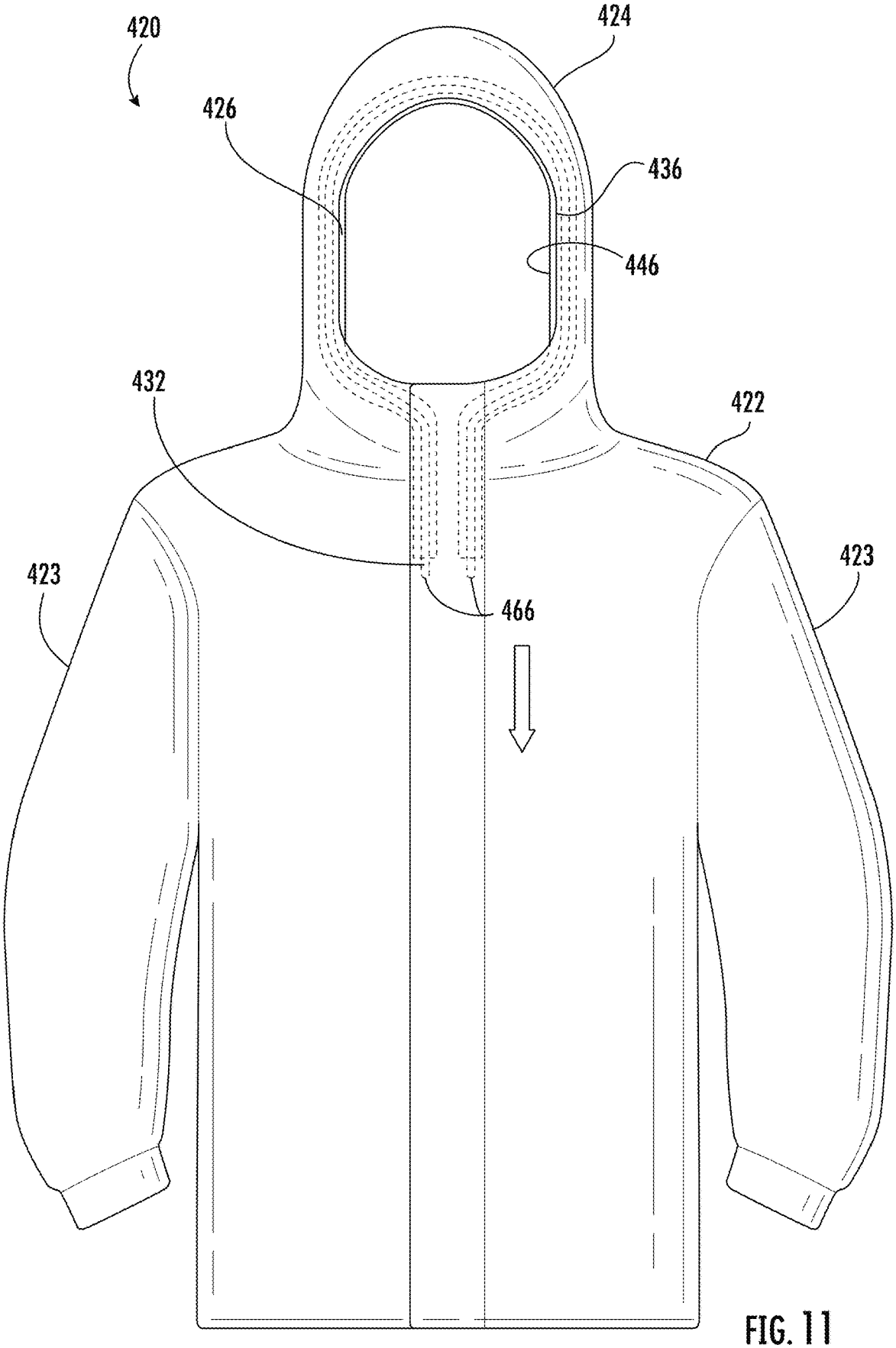
FIG. 11 is a front view of an example hooded garment having an inner hood in an unconstricted state.

Drawstring 366 comprises an elongate, flexible band, rope, cord, string or the like which is threaded interior of sleeve 350, wherein opposite ends of drawstring 366 project through sleeve openings 367. Drawstring 366 is slidably movable within and along sleeve 350. As shown by FIGS. 9 and 10, the ends of drawstring 366 may be pulled in a downward direction as indicated by arrow 369 to constrict inner face opening 46 about and into closer conformity with the face and head of the person wearing garment 320.

Referring to FIGS. 9 and 10, in some implementations, the pulled or drawn state of the drawstrings 366 may be retained to better retain inner face opening 46 in the constricted state. For example, in some implementations, the opposite end portions of drawstring 366, those that project from sleeve opening 367, may be tied to one another. In some implementations, garment 320 may additionally comprise one or more cord locks 370, such as a toggle spring cord lock, an ellipse toggle cord lock or a barrel toggle cord lock, fastened to garment 20 or sized larger than sleeve opening 367 (to prevent the cord lock from being drawn into sleeve openings 367), wherein the opposite end portions of drawstring 366 pass through the cord lock 370 and are maintained in a selected pulled or drawn state to retain inner face opening 46 in the chosen constricted state. Release of the cord lock may allow the inner face opening 46 to once again be unconstricted and expanded to facilitate removal of inner hood 326 (and outer hood 24) from the person's head or to provide greater air flow through inner face opening 46. Such expansion or on constriction of inner face opening 46 does not correspondingly change the shape or size of outer hood 24.

FIGS. 11-15 illustrate portions of an example hooded garment 420. FIGS. 11-15 illustrate an example of how an insulated garment may be provided with an insulated inner hood and an outer weather resistant hood, wherein the insulated inner hood may be constricted without corresponding constriction of the outer weather resistant hood. Hooded garment 420 comprises body portion 422, outer hood 424, inner hood 426, lead 428 (shown in FIGS. 13-15) and inner face opening constrictor 432.

Body portion 422 comprises that portion of garment 420 that may cover at least portions of a person's back and chest. In the illustrated example, body portion 422 comprises sleeves 423 for receiving a person's arms. In some implementations, such sleeves may be omitted. Body portion 422 comprises a neck opening for receiving a person's neck and from which a person's head may project when garment 420 is being worn.

Body portion 422 may have various configurations with various layers. Body portion 422 can comprise an outer weather resistant layer 500 and an inner insulated layer 502. In the example illustrated, the outer weather resistant layer 500 is formed from material panels that continue from outer hood 424. The outer weather resistant layer 500 can continue from the outer hood 424 to the body portion 422 across both the back and the chest of the person wearing garment 420. Likewise, the inner hood 426 can include the inner insulated layer 502 formed from material panels that can continue from the body portion 422. The inner insulated layer 502 of the inner hood 426 can continue across both the back and the chest of the person wearing garment 420. In the example illustrated, both layers 500 and 502 continue to form sleeves 423. In other implementations, one or both of the outer layer and/or the inner layer can be formed in the outer and inner hoods only with separate materials forming inner and outer layers of the body portion. Alternatively, the inner insulated layer of the inner hood can be spaced apart from an inner insulated layer of the body portion of the garment. In such implementations, outer hood 424 and inner hood 426 may be separately formed from components which are stitched, laminated or otherwise secured to the separate panels forming body portion 422.

The outer weather resistant layer 500 can comprise one or more layers of material. In one implementation, one or more of the layers forming the outer weather resistant layer 500 can comprise a breathable water-resistant material such as an expanded polytetrafluoroethylene (ePTFE) material such as Gore-Tex™. In one implementation, the outer weather resistant layer 500 can include a nylon, such as a 70 Denier ripstop nylon. In other implementations, the outer weather resistant layer 500 can be formed from other materials or material combinations.

In the example illustrated, the inner hood 426 can include an inner insulated layer 502 comprises a layer of insulative material. In some implementations, layers 500 and/or 502 may not be a continuation of outer hood 424 and inner hood 426 as illustrated. In such implementations, outer hood 424 and inner hood 426 may be separately formed components which are stitched, laminated or otherwise secured to the separate panels forming body portion 422.

Outer hood 424 projects from body portion 422 and includes a face opening 436. Face opening 436 faces in a forward direction as indicated by arrow 448 and is located so as to at least partially expose the face of the person wearing garment 420. Outer hood 424 is configured to extend over the head of a person wearing the garment 420, covering the top, sides and rear of the head of the person wearing garment 420. Outer hood 424 has an outer weather resistant surface, a surface that is formed from a material so as to offer resistance to penetration of wind and/or moisture, such as rain or snow. In the example illustrated, outer hood 24 is be formed from a material that is "breathable" yet is also weather resistant.

In the example illustrated, outer hood 424 is formed from a layer of material that is a continuation of an outer layer of material that also forms an exterior of body portion 422. In the example illustrated, outer hood 424 is formed from outer weather resistant layer such as a breathable water-resistant material such as an expanded polytetrafluoroethylene (ePTFE) material such as Gore-Tex™.

In the example illustrated, the outer hood 424 includes an outer brim portion 460 that overhangs and extends forwardly beyond an inner brim portion 462 of the inner hood 426. In the example illustrated, outer brim portion 460 is formed from a first weather resistant layer 510 that extends to a forwardmost edge 506 of the outer brim portion 460 and wraps around a reinforcing member 508 forming a second weather resistant layer 512. The reinforcing member 508 is sandwiched between first and second weather resistant layers 510 and 512. In other implementations, the first and second weather resistant layers 510 and 512 can overlie each other and be bonded, pressure molded or otherwise connected to form the forwardmost edge 506. In one implementation, the reinforcing member 508 and the first and second weather resistant layers 510 and 512 are adhesively bonded, laminated and/or heat pressed together to form the outer brim portion 460. In one implementation, the reinforcing member 508 can be formed of a nylon. In other implementations, the reinforcing member 508 can be formed of one or more other materials. In some implementations, the reinforcing member 508 may be removed in regions rearward of lead 428. In other implementations, one or more reinforcing members can be incorporated into other regions of the outer hood 424 rearward of the lead 428 to provide a greater degree of flexibility in such regions. In some implementations, reinforcing member 508 may be omitted where the first and second weather resistant layers 510 and 512 offer sufficient bending stiffness.

Inner hood 426 projects from body portion 422 within outer hood 424. Inner hood 426 comprises an inner face opening 446 that faces in a forward direction as indicated by arrow 448. Inner face opening 446 is configured (sized and located) to at least partially expose the face of the person wearing garment 420.

In the example illustrated, inner face opening 446 of inner hood 426 is rearwardly recessed with respect to face opening 436 about hood 424. In the example illustrated, the top forward point of the forwardmost edge 506 of the outer face opening 436 of outer hood 424 extends forward (as indicated by arrow 448) and beyond of a top forward edge of inner face opening 446 of inner hood 426. As a result, outer hood may better deflect or direct in a downwardly moving moisture (rain or snow) away from inner face opening 446 and the face of the person wearing garment 420. In some implementations, outer hood 424 may project forward of a top of inner face opening 446 by at least 1.0 inch. In other implementations, the top of inner face opening 436 and the top of outer face opening 446 may be coextensive or vertically aligned.

Figure 14:
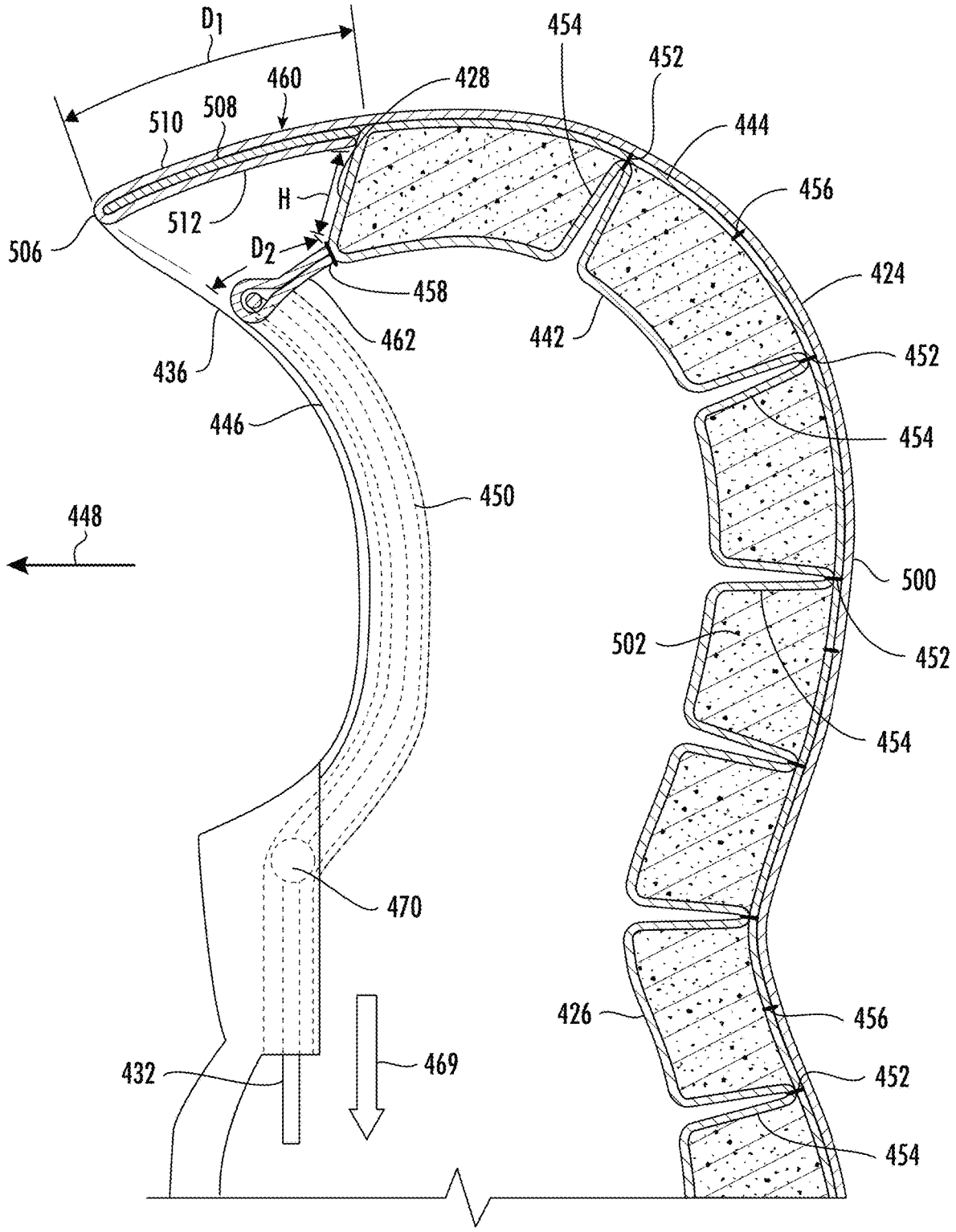
FIG. 14 is a fragmentary sectional view of the example hooded garment of FIG. 11.

In the example illustrated, inner hood 426 is formed from one or more layers of material that are a continuation of the one or more inner layers of material that also form the interior layer of body portion 422. In the example illustrated, the inner hood 426 includes first and second inner hood layers 442 and 444 that surround or encapsulate an inner insulated layer 502 formed of one or more layers or compartments of insulative material. Referring to FIG. 14, in one implementation, the inner insulated layer 502 comprises a layer of down material. In one particular implementation, layer 502 comprises an 850 Fill goose down. In other implementations, other forms of down can be used. In some implementations, the down material may be water resistant. The first and second inner hood layers 442 and 444 can include a plurality of seam lines 452 that collectively form a plurality of baffles 454 for retaining or encapsulating the down fill material. The seam lines 452 attach the first and second inner hood layers 442 and 444 together and can be formed from stitches, adhesives, other bond lines and combinations thereof. The baffles 454 retain the down fill material at discrete locations about the inner hood 426 and prevent the down fill material from collecting in a lower region or other portion of the inner hood.

Figure 15:
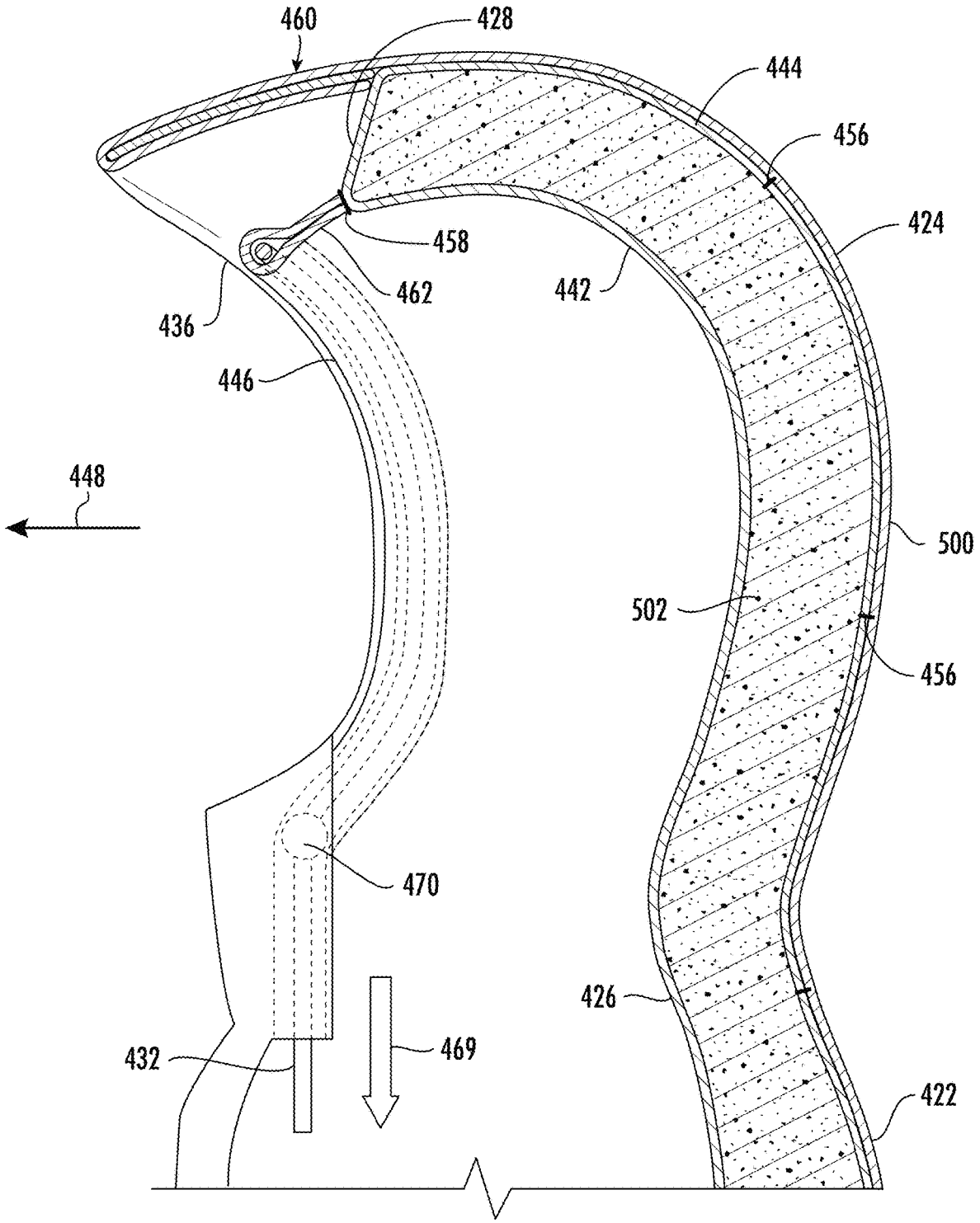
FIG. 15 is a fragmentary sectional view of the example hooded garment of FIG. 12.

Referring to FIG. 15, in other implementations, the inner insulated layer 502 can be formed by one or more sheets or panels of insulated material. When one or more sheets or panels of insulated material are used for the inner insulated layer 502 there is no need to form a plurality of baffles because the insulating material can be retained in the inner hood 426 in a manner that avoids bunching, collecting or other undesirable movement of the insulating material within the inner hood 426.

In each of the embodiments of FIGS. 14 and 15 the second inner hood layer 444 of the inner hood 426 is attached to the outer hood 424. In one implementation, the second inner hood layer 444 is attached to the outer hood 424 through a plurality of tacks 456. The tacks 456 are discrete connection points positioned at two or more locations about the surface area of the second inner hood layer 444 and the outer hood 424. In one implementation, the tacks 456 are stitches. In other implementations, the tacks can be formed by other means such as, for example, adhesive, welding, snaps, rivets or other fasteners. The number of tacks 456 can be within the range of 2 to 12. The tacks 456 attach the second inner hood layer 44 to the outer hood 424 at the discrete points thereby securing the inner hood 426 to the outer hood 424 while still providing for portions of the surfaces of the second inner hood layer 444 of the inner hood 426 to be unattached and free to move independently of the outer hood 424. In other implementations, the second inner hood layer 444 of the inner hood 426 can be attached to the outer hood 424 through other means such as stitch lines, bonding lines, welding lines, and/or bonding, welding or press molding regions of the layers together.

Lead 428 (shown in FIGS. 13-15) comprises one or more structures that serve as a connector connecting the inner hood 426 to an interior of outer hood 424 at a single location or multiple locations above body portion 422 and rearward of inner face opening 446 of inner hood 426. Lead 428 inhibits or restricts the entirety of outer hood 424 being moved or pulled off of the head of the person wearing garment 420 without also being moved or pulled off of the head of the person wearing garment 420. Lead 428 assists in retaining outer hood 424 about the head of the person wearing garment 420. Because outer hood 424 is connected to inner hood 426, outer hood 424 is better retained on the head of the person wearing garment 420.

In the example illustrated, lead 428 comprises a continuous elongate panel extending parallel to and/or along a majority of the inner face opening 446, but rearward of the inner face opening 446, wherein the panel faces in a forward direction (as indicated by arrow 448). In some embodiments, such as examples of FIGS. 14 and 15, the lead 428 extends over the forwardmost portion of the inner insulated layer 502, and formed as part of the inner hood 426. The upper and lower ends of lead 428 may be joined to outer hood 424 and the inner brim portion 462 of the inner hood 426 in various fashions. In some implementations, such ends may be secured by stitching, adhesives, welding, or the like. In FIGS. 14 and 15, the lower end of the lead 428 is connected to the inner brim portion 462 by a stitching 458 and the upper end of the lead 428 is integrated into the second inner hood layer 444 of the inner hood 426. In some implementations, one of such ends may be secured by a first technique while the other of such ends is secured by a different technique. In the example illustrated, the top portion or end of lead 428 may be secured to outer hood 424 by a glue, lamination or adhesive while the lower end of lead 428 may be secured to the inner brim portion 462 of the inner hood 426 by stitching. In other implementations, lead 428 may be integrally formed as a single unitary body with a material panel forming a portion of outer hood 424 and/or a material panel forming portions of inner hood 426.

In some implementations, lead 428 is inelastic. In other implementations, lead 428 is elastic or resilient stretchable. For example, in some implementations, the overall structure of outer hood 424 may be sufficiently rigid or stiff such that lead 428 may be resiliently stretched to accommodate a desired degree of constriction of inner hood 426 while the shape and size of outer hood 424 is maintained.

In some implementations, lead 428 may have a height H of at least 0.25 inch. In other implementations, the lead 428 can have a height H within the range of 0.25 to 2.0 inches. In some implementations, lead 428 may be connected to outer hood 424 at a distance D1 of at least 1 inch rearward of the forwardmost edge 506 of outer face opening 436. Distance D1 also defines the length of the outer brim portion 460. In other implementations, the distance D1 of the outer brim portion 460 can have a dimension within the range of 0.5 to 6 inches. In other implementations, the distance D1 can be within the range of 2.5 to 4 inches. In some implementations, lead 28 may be connected to inner hood 426 at a distance D2 of at least 1 inch rearward of the forward most point of inner face opening 446. The distance D2 corresponds to the length of the inner brim portion 462. In some implementations, the distance D2 can be within the range of 1 to 4 inches. In some implementations, the D1 is greater than or equal to distance D2. In some implementations, the height H of lead 428, and the length of the inner brim portion 462 of inner hood 426 extending forward of lead 428, distance D2, has a combined length of at least 1.0 inches and no greater than 5 inches. In one implementation, the distance D1 is approximately 3.5 inches, the height H is approximately 1 inch and the distance D2 is approximately 2 inches. In some implementations, the combined length of the height H of lead 428 and the length of the inner brim portion 462 of inner hood 426, D2, has a combined length of at least 1.0 inches and no greater than 5.0 inches. In some implementations, combined length of the height H of lead 28 and the length of the inner brim portion 462, D2, has a combined length within the range of 1.5 to 3.5 inches. As will be described hereafter, this combined length impacts the ability of those portions of inner hood 426 along inner face opening 446 to be constricted without corresponding constriction of outer hood 424.

Inner face opening constrictor 432 comprises a mechanism by which the inner face opening 446 of inner hood 426 may be constricted or tightened about and against the head or face of the person wearing garment 420. In the example illustrated, outer hood 424 comprises an outer brim portion 460 that extends forwardly (in the direction indicated by arrow 448) from lead 428 and which terminates at the forward edge of outer face opening 436. Inner hood 426 includes the inner brim portion 462 that extends forwardly from lead 428 and which terminates at the forward edge of inner face opening 446. Inner face opening constrictor 432 comprises a mechanism that is configured to constrict inner brim portion 462 about and against the head or face of the person wearing garment 420 without corresponding constriction of outer brim portion 460.

In the example illustrated, outer brim portion 460 overhangs and extends forwardly beyond inner brim portion 462. Outer brim portion 460 has a bending stiffness, or a resistance to bending, that is greater than the bending stiffness of inner brim portion 462. In other words, outer brim portion 460 is less likely to bend or wrinkle and is more likely to retain a shape as compared to inner brim portion 462 when experiencing the same forces. At the same time, inner brim portion 462 may be more easily bent, deformed or constricted about the face or head of the person wearing garment 420.

Figure 12:
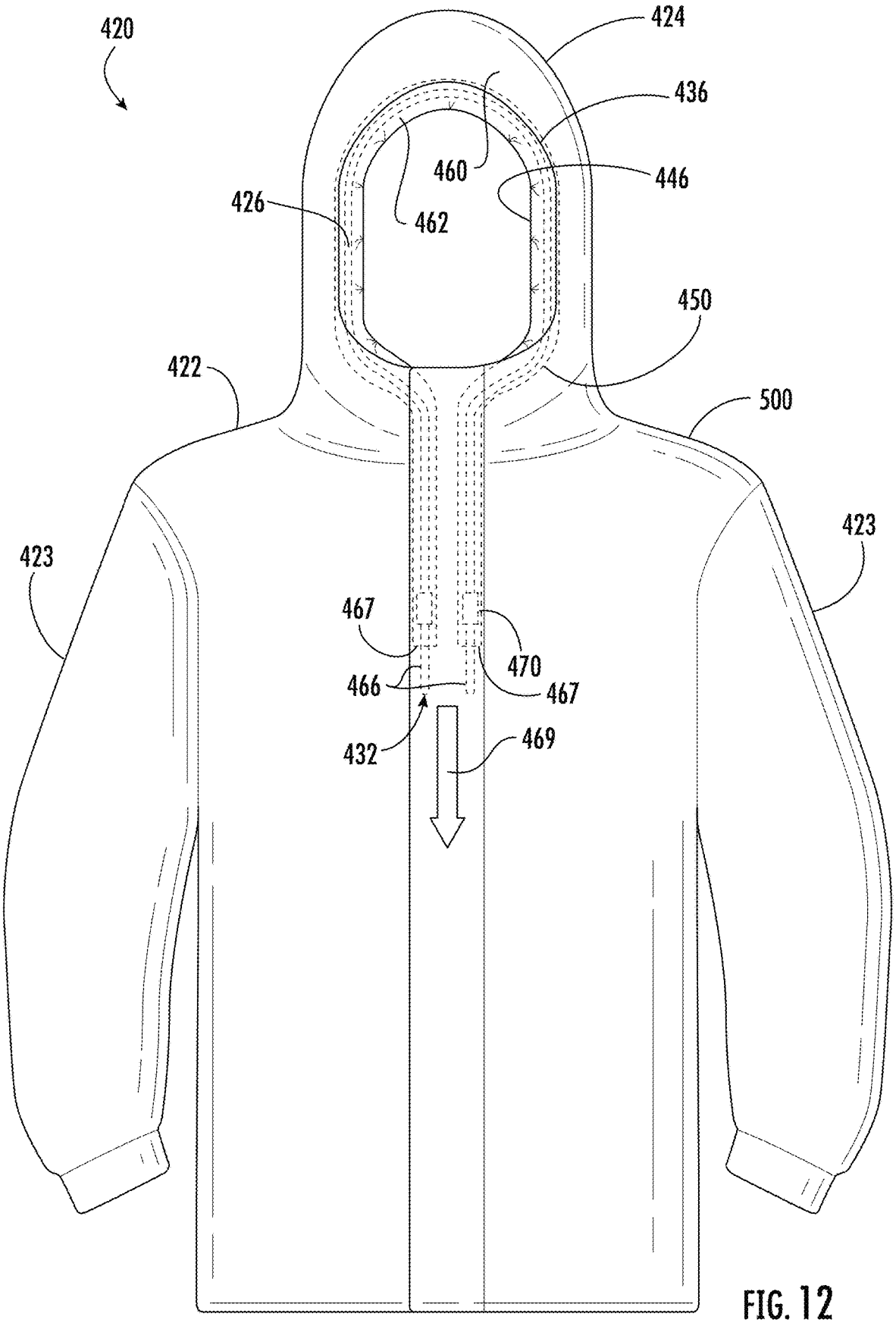
FIG. 12 is a front view of the example hooded garment of FIG. 11 with the inner hood in a constricted state.
Figure 13:
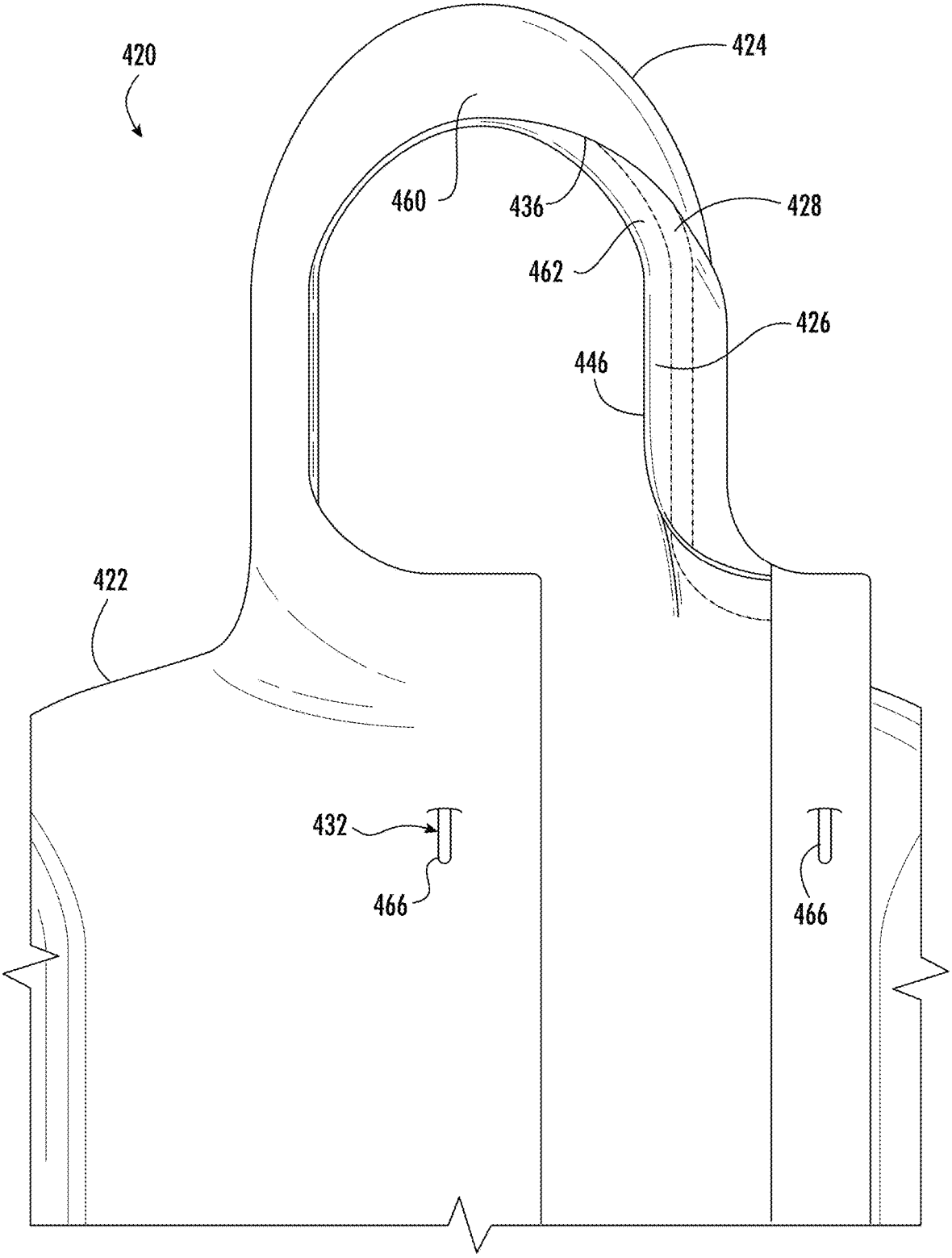
FIG. 13 is a front view of the example hooded garment of FIG. 11 illustrating portions of an outer hood pulled back from the inner hood to expose an example lead connecting the outer hood in the inner hood.

Inner hood 426 comprises a sleeve 450 which extends along the inner face opening 446. Sleeve 450 comprise a tube which extends along the inner face opening 446. Sleeve 450 guides and slidably receives constrictor 432 which is in the form of a drawstring 466. Although illustrated as a continuous, uninterrupted sleeve, sleeve 450 may alternatively comprise a series of spaced sleeves along inner face opening 446 and through which drawstring 466 extends. In some implementations, sleeve 450 forms the edge of the inner face opening 446. In some implementations, sleeve 450 extends slightly rearward of the forward edge of inner face opening 446. Although sleeve 450 is illustrated as having drawstring openings 467 along body portion 22 as shown in FIG. 12, in other implementations, such drawstring opening 467 may be located at the lower end of face opening 446 or at other locations.

Drawstring 466 comprises an elongate, flexible band, rope, cord, string or the like which is threaded interior of sleeve 450, wherein opposite ends of drawstring 466 project through sleeve opening 467. Drawstring 466 is slidably movable within and along sleeve 450. As shown by FIG. 15, the ends of drawstring 466 may be pulled in a downward direction as indicated by arrow 469 to constrict inner face opening 446 about and into closer conformity with the face and head of the person wearing garment 420.

In some implementations, the pulled or drawn state of the drawstrings may be retained to better retain inner face opening 446 in the constricted state. For example, in some implementations, the opposite end portions of drawstring 466, those that project from sleeve opening 467, may be tied to one another. In some implementations, garment 420 may additionally comprise one or more cord locks 470 (shown in broken lines), such as a toggle spring cord lock, an ellipse toggle cord lock or a barrel toggle cord lock fastened to garment 420, wherein the opposite end portions of drawstring 466 pass through the cord lock 470 and are maintained in a selected pulled or drawn state to retain inner face opening 446 in the chosen constricted state. Release of the cord lock 470 may allow the inner face opening 446 to once again be unconstricted and expanded to facilitate removal of inner hood 426 (and outer hood 424) from the person's head or to provide greater air flow through inner face opening 446. Such expansion or on constriction of inner face opening 446 does not correspondingly change the shape or size of outer hood 424.

FIGS. 16-22 illustrate portions of an example hooded garment 620. FIGS. 16-22 illustrate an example of how the hood of a hooded garment may be constructed so as to allow a person wearing the hooded garment to independently constrict the top of an inner hood and also independently constrict sides of a face opening of the inner hood without correspondingly changing the shape or size of an outer hood. Hooded garment 620 comprises body portion 622, outer hood 624, inner hood 626, lead 628, inner face opening constrictor 632 and inner hood top constrictor 634.

Figure 16:
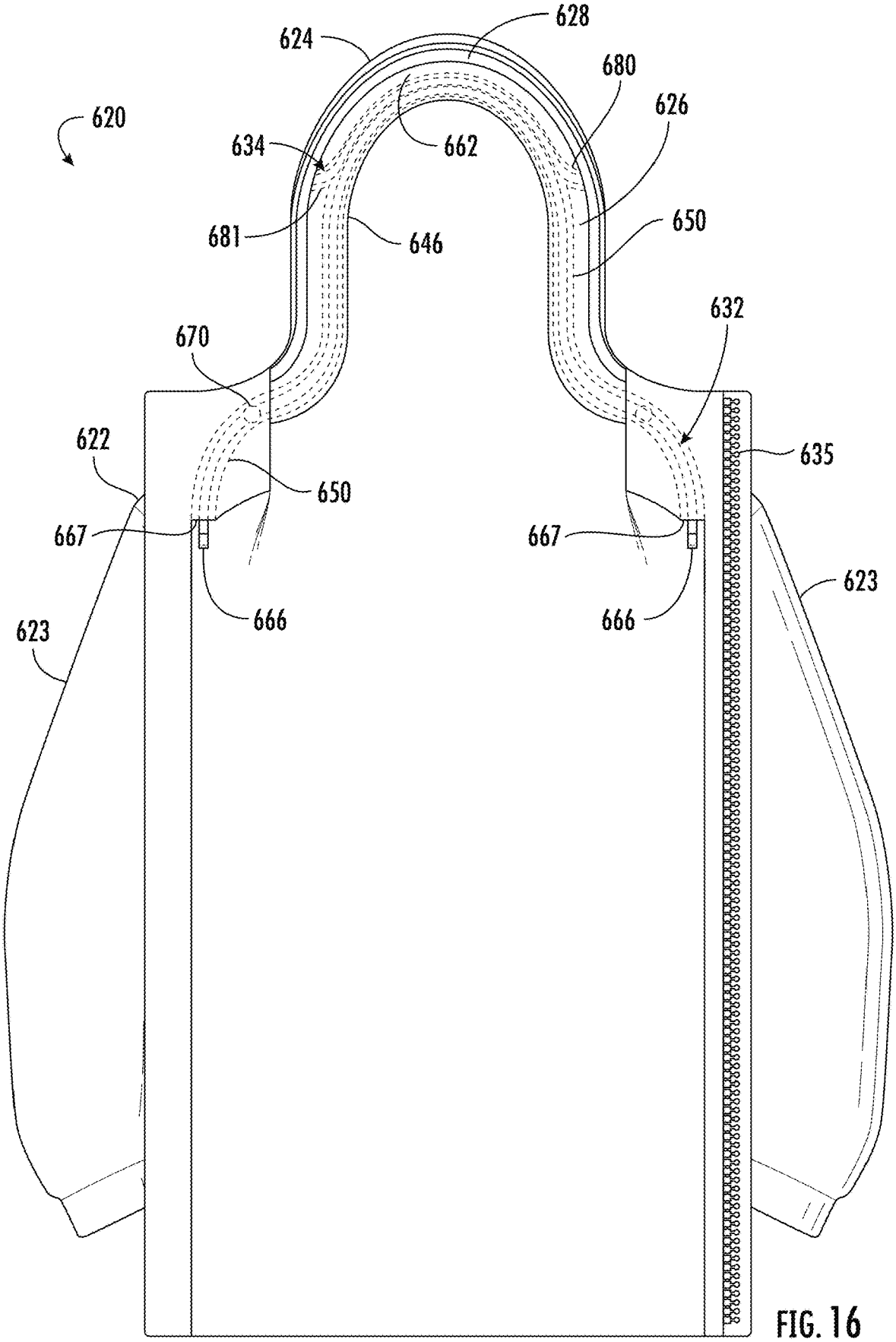
FIG. 16 is a front perspective view illustrating portions of an example hooded garment in an opened state with a non-constricted inner hood.

Body portion 622 is similar to body portion 422 described above. As shown by FIG. 16, body portion 622 has a front opening with a closing mechanism in the form of a zipper 635. As discussed above with respect to body portion 422, body portion 622 comprises that portion of garment 420 that may cover at least portions of a person's back and chest. In the illustrated example, body portion 622 comprises sleeves 623 for receiving a person's arms. In some implementations, such sleeves may be omitted. Body portion 622 comprises a neck opening for receiving a person's neck and from which a person's head may project when garment 620 is being worn.

Outer hood 624 projects from body portion 622 and includes a face opening 636. Face opening 636 faces in a forward direction as indicated by arrow 648 and is located so as to at least partially expose the face of the person wearing garment 620. Outer hood 624 is configured to extend over the head of a person wearing the garment 620, covering the top, sides and rear of the head of the person wearing garment 620. Outer hood 624 has an outer weather resistant surface, a surface that is formed from a material so as to offer resistance to penetration of wind and/or moisture, such as rain or snow. In the example illustrated, outer hood 624 is be formed from a material that is "breathable" yet is also weather resistant.

In the example illustrated, outer hood 624 is formed from a layer of material that is a continuation of an outer layer of material that also forms an exterior of body portion 622. In the example illustrated, outer hood 624 is formed from outer weather resistant layer such as a breathable water-resistant material such as Gore-Tex™. Inner hood 626 projects from body portion 622 within outer hood 624. Inner hood 626 comprises an inner face opening 646 that faces in a forward direction as indicated by arrow 648. Inner face opening 646 is configured (sized and located) to at least partially expose the face of the person wearing garment 620.

In the example illustrated, inner face opening 646 of inner hood 626 is rearwardly recessed with respect to face opening 636 about hood 624. In the example illustrated, a forwardmost edge 606 of an outer brim portion 660 of outer face opening 636 of outer hood 624 extends forward (as indicated by arrow 648) and beyond the top forward edge of inner face opening 646 of inner hood 626. As a result, outer hood may better deflect or direct in a downwardly moving moisture (rain or snow) away from inner face opening 646 and the face of the person wearing garment 620. In some implementations, outer hood 624 may project forward of a top of inner face opening 646 by at least 1.0 inch. In other implementations, the top of inner face opening 636 and the top of outer face opening 646 may be coextensive or vertically aligned.

In the example illustrated, inner hood 626 is formed from a layer of material that is a continuation of the inner layer of material that also forms the interior layer of body portion 622. In the example illustrated, inner hood 626 comprises a layer of insulative material. In other implementations, outer hood 424 and inner hood 426 may be separately formed from components which are stitched, laminated or otherwise secured to the separate panels forming body portion 422.

Lead 628 comprises one or more structures that serve as a connector connecting the inner hood 626 to an interior of outer hood 624 at a single location or multiple locations above body portion 622 and rearward of inner face opening 646 of inner hood 626. Lead 628 inhibits or restricts the entirety of outer hood 624 from being moved or pulled off of the head of the person wearing garment 620 without the inner hood 626 also being moved or pulled off of the head of the person wearing garment 620. Lead 628 assists in retaining outer hood 624 about the head of the person wearing garment 620. Because inner hood 626 more closely fits about the head of the person wearing garment 620, it is less likely to be accidentally pulled back or off of the head of the person wearing garment 620.

Figure 17:
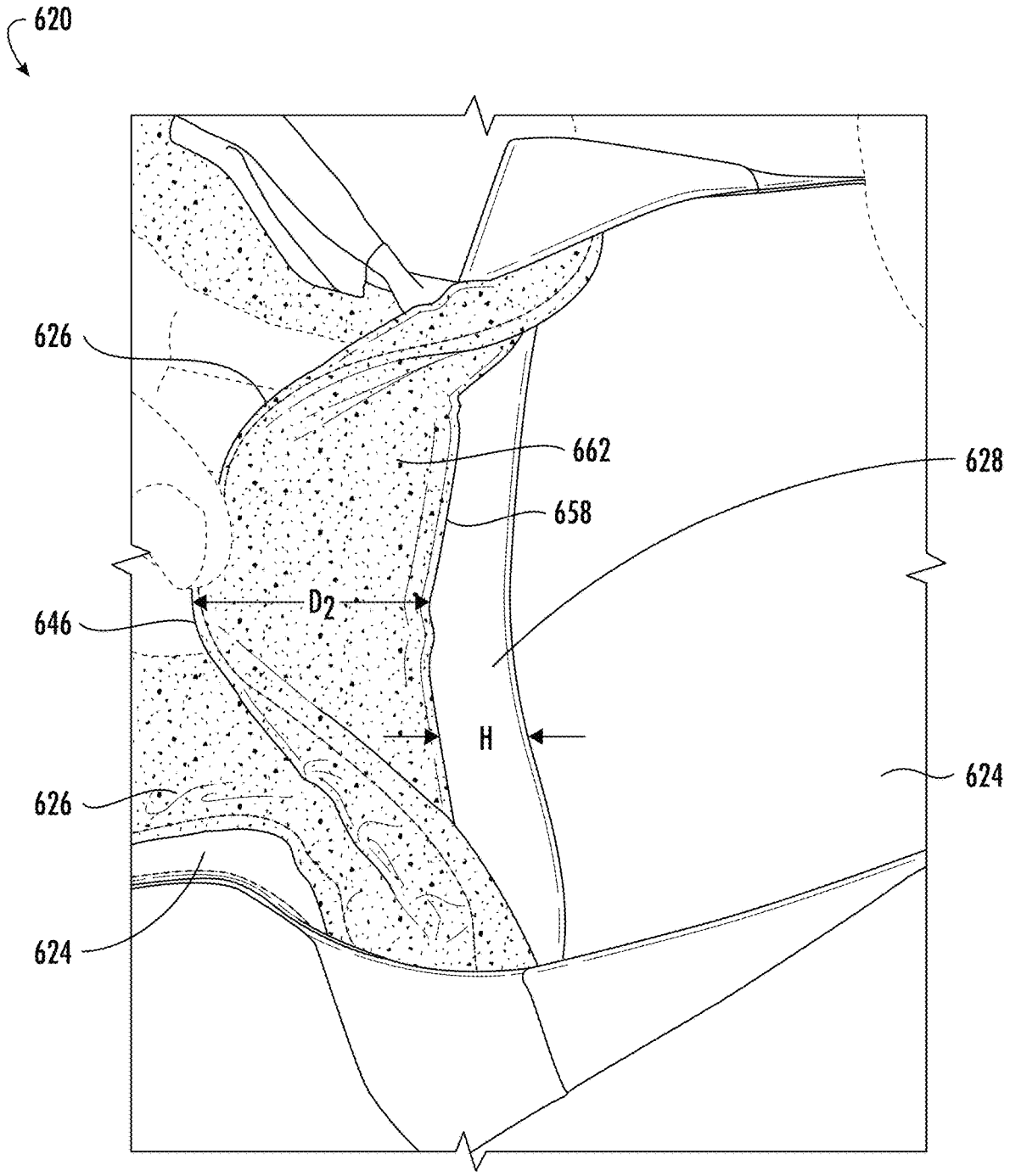
FIG. 17 is an enlarged fragmentary perspective view illustrating portions of the inner hood manually peeled away from portions of an outer hood to better reveal an intermediate lead connecting the inner hood and the outer hood of the hooded garment of FIG. 16.
Figure 22:
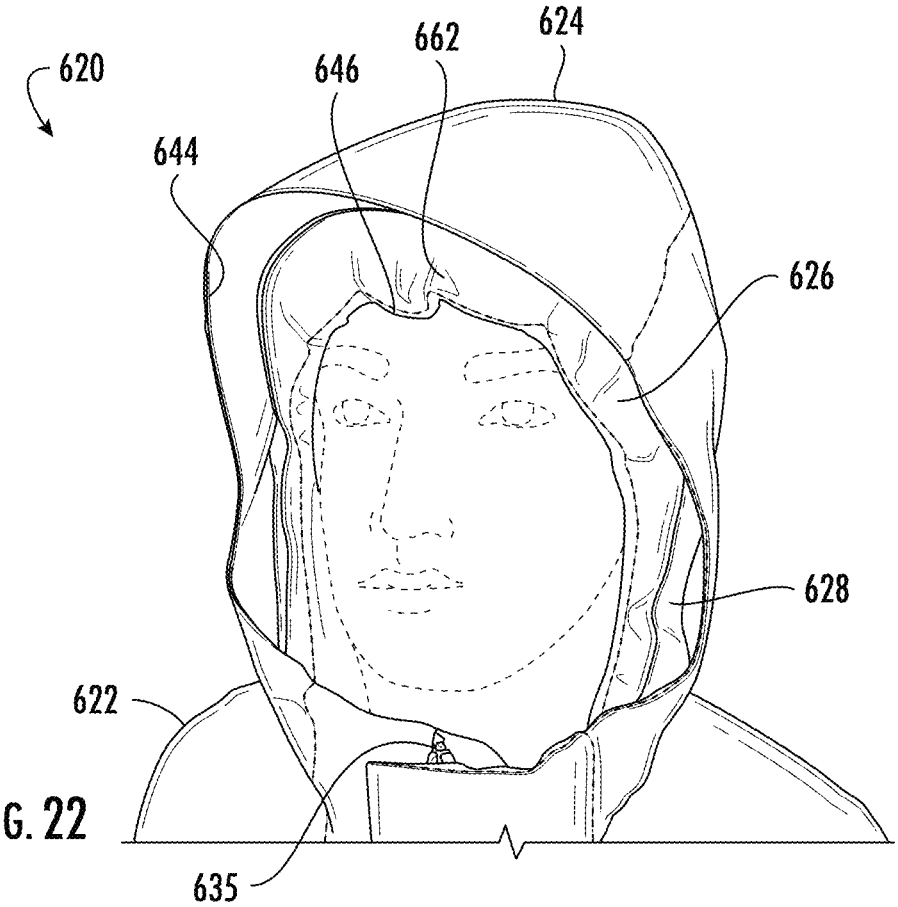
FIG. 22 is a front perspective view of the example hooded garment of FIG. 21A.

FIG. 17 illustrates an inner brim portion 662 of the inner hood 626 (denoted with stippling) and its face opening 646, being pulled away from the inner surface of outer hood 624. As shown by FIGS. 16 and 22, lead 628 comprises a continuous elongate panel extending parallel to and/or along a majority of the inner face opening 646, but rearward of the inner face opening 646, wherein the lead 628 faces in a forward direction. In other words, lead 628 is a forwardly facing panel that extends at least 180 degrees about and rearward the inner face opening 646. The upper and lower ends of lead 628 may be joined to outer hood 624 and inner hood 626 in various fashions. In some implementations, such ends may be secured by adhesive, welding, stitching or the like. In some implementations, one of such ends may be secured by a first technique while the other of such ends is secured by a different technique. In the example illustrated, the lower end of the lead 628 is connected to the inner brim portion 662 by a stitching 658 and the upper end of the lead 628 is integrated into a second inner hood layer of the inner hood 626. In other implementations, the lower and/or upper ends of the lead 628 may be secured to outer hood 624 by a glue, lamination or adhesive, stitching or combinations thereof. In other implementations, lead 628 may be integrally formed as a single unitary body with a material panel forming a portion of inner hood 626.

In some implementations, lead 628 is inelastic. In other implementations, lead 628 is elastic or resilient stretchable. For example, in some implementations, the overall structure of outer hood 624 may be sufficiently rigid or stiff such that lead 628 may be resiliently stretched to accommodate a desired degree of constriction of inner hood 626 while the shape and size of outer hood 624 is maintained.

In some implementations, lead 628 may have a height H of at least 0.25 inch. In other implementations, the lead 628 can have a height H within the range of 0.25 to 2.0 inches. In some implementations, lead 628 may be connected to outer hood 624 at a distance D1 of at least 1 inch rearward of the forwardmost edge 606 of outer face opening 636. Distance D1 also defines the length of the outer brim portion 660. In other implementations, the distance D1 of the outer brim portion 660 can have a dimension within the range of 0.5 to 6 inches. In other implementations, the distance D1 can be within the range of 2.5 to 4 inches. In some implementations, lead 628 may be connected to inner hood 626 at a distance D2 of at least 1 inch rearward of the forward most point of inner face opening 646. The distance D2 corresponds to the length of the inner brim portion 662. In some implementations, the distance D2 can be within the range of 1 to 4 inches. In some implementations, the D1 is greater than or equal to distance D2. In some implementations, the inner brim portion 662 and the lead 628 having combined length that is equal to or less than the length of the outer brim portion 660. In some implementations, the height H of lead 628, and the length of the inner brim portion 662 of inner hood 626 extending forward of lead 628, distance D2, has a combined length of at least 1.0 inches and no greater than 5 inches. In one implementation, the distance D1 is approximately 3.5 inches, the height H is approximately 1 inch and the distance D2 is approximately 2 inches. In some implementations, the combined length of the height H of lead 628 and the length of the inner brim portion 662 of inner hood 626, D2, has a combined length of at least 1.0 inches and no greater than 5.0 inches. In some implementations, combined length of the height H of lead 628 and the length of the inner brim portion 662, D2, has a combined length within the range of 1.5 to 3.5 inches. As will be described hereafter, this combined length impacts the ability of those portions of inner hood 626 along inner face opening 646 to be constricted without corresponding constriction of outer hood 624.

Inner face opening constrictor 632 is similar to inner face opening constrictor 432 described above except that inner face opening constrictor 632 has more of an inverted U-shape to constrict the sides of the inner face opening inwards with a lesser degree of the inner face opening being constricted about or underneath the chin of the person wearing the hooded garment. Inner face opening constrictor 632 comprises a mechanism by which the inner face opening 646 of inner hood 626 may be constricted or tightened about and against the sides of the head or face of the person wearing garment 620.

In the example illustrated, outer brim portion 660 overhangs and extends forwardly beyond inner brim portion 662. Outer brim portion 660 has a bending stiffness that is greater than the bending stiffness of inner brim portion 662. In other words, outer brim portion 660 is less likely to bend or wrinkle and is more likely to retain a shape as compared to inner brim portion 662 when experiencing the same forces. At the same time, inner brim portion 662 may be more easily deformed or constricted about the face or head of the person wearing garment 620. In some implementations, the outer brim portion 660 has a bending stiffness that is at least 5 times as large as, or at least 5 times greater than, the bending stiffness of inner brim portion 662. In some implementations, the outer brim portion 660 has a bending stiffness that is at least 6 times as large as, or at least 6 times greater than, the bending stiffness of inner brim portion 662. In some implementations, the outer brim portion 660 has a bending stiffness that is at least 8 times as large as, or at least 8 times greater than, the bending stiffness of inner brim portion 662. The degrees of bending stiffness and the relative degree of bending stiffness between outer hood 624 and inner hood 626 impact the ability of constrictor 632 to constrict inner brim portion 662 without correspondingly constricting outer brim portion 460.

Inner hood 626 comprises a sleeve 650 which extends along the inner face opening 646. Sleeve 650 comprise a tube which extends along the inner face opening 646. Sleeve 650 guides slidably receives constrictor 632 which is in the form of a drawstring 666. Although illustrated as a continuous, uninterrupted sleeve, sleeve 650 may alternatively comprise a series of spaced sleeves along inner face opening 646 and through which drawstring 466 extends. In some implementations, sleeve 650 forms the edge of the inner face opening 446. In some implementations, sleeve 650 extends slightly rearward of the forward edge of inner face opening 646.

In some implementations, the pulled or drawn state of the drawstrings may be retained to better retain inner face opening 646 in the constricted state. For example, in some implementations, the opposite end portions of drawstring 666, those that project from sleeve opening 667, may be tied to one another. In some implementations, garment 620 may additionally comprise a cord lock 670 (shown in broken lines), such as a toggle spring cord lock, an ellipse toggle cord lock or a barrel toggle cord, wherein the opposite end portions of drawstring 666 pass through the cord lock 670 and are maintained in a selected pulled or drawn state to retain inner face opening 646 in the chosen constricted state. Release of the cord lock 670 may allow the inner face opening 646 to once again be unconstricted and expanded to facilitate removal of inner hood 626 (and outer hood 624) from the person's head or to provide greater air flow through inner face opening 646. Such expansion or on constriction of inner face opening 646 does not correspondingly change the shape or size of outer hood 624.

Figure 18:
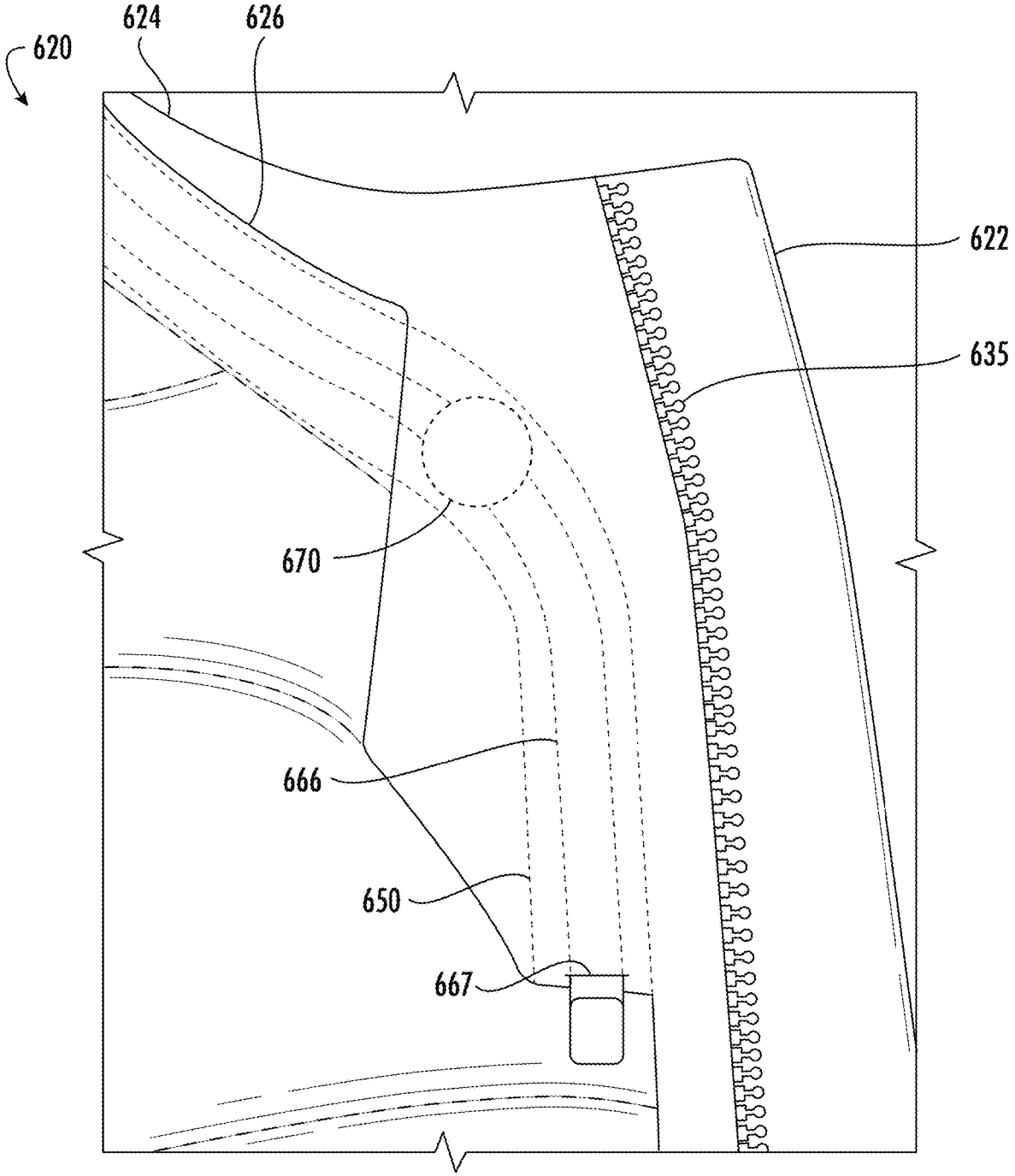
FIG. 18 is an enlarged fragmentary perspective view illustrating an example drawstring exiting from a body portion of the hooded garment of FIG. 16.

As shown by FIG. 18, sleeve 650 exits the inner hood 626 and further extends along an inside face of body portion 622, exiting at drawstring opening 667. In the example illustrated, cord lock 670 is anchored along sleeve 650 at a location proximate to where the sleeve 650 exits the inner hood 626. The cord lock 670, although hidden and captured within or between the layers of material forming body portion 622, may be manually manipulated through the layers of material between and an at rest retaining state in which the cord lock 670 locks against the drawstring 666 to inhibit further drawing of the drawstring 666 through opening 667 and a loosened state, permitting drawstring 666 to be further pulled through the cord lock 670 and through the opening 667 for a greater degree of constriction. Although sleeve 650 is illustrated as having drawstring openings 667 along body portion 22 as shown in FIG. 18, in other implementations, such drawstring openings 667 may be located at the lower end of face opening 646 or at other locations.

Figure 21A:
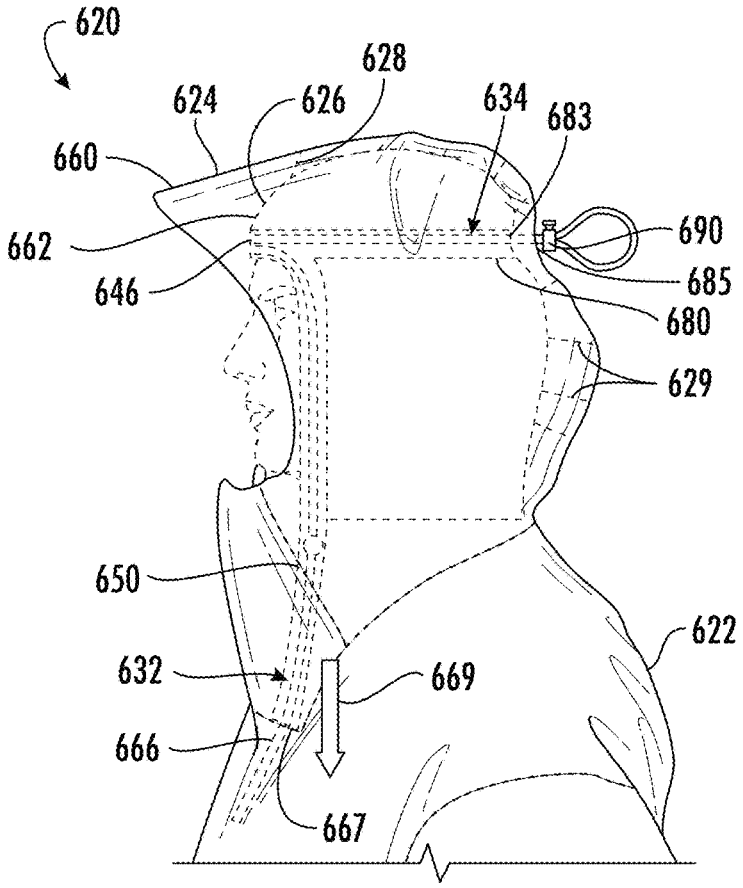
FIG. 21A is a side view of the example hooded garment of FIG. 16, illustrating both an example inner face opening constrictor and an example inner hood top constrictor in constricted states.

Drawstring 666 comprises an elongate, flexible band, rope, cord, string or the like which is threaded interior of sleeve 650, wherein opposite ends of drawstring 666 project through sleeve opening 667. Drawstring 666 is slidably movable within and along sleeve 650. As shown by FIG. 21A, the ends of drawstring 666 may be pulled in a downward direction as indicated by arrow 669 to constrict inner face opening 646 about and into closer conformity with the face and head of the person wearing garment 620.

Inner hood top constrictor comprises a mechanism by which the top of inner hood 626, covering the crown of the head of the person wearing garment 620, may be constricted or tightened horizontally about and against the top of the head of the person wearing garment 620. In the example illustrated, inner hood 626 comprises a sleeve 680 which extends from a portion of sleeve 650, along the forehead of the person wearing inner hood 626, and along the opposite sides of hood 626 above or otherwise proximate and above the ears of the person wearing hood 626. In the example illustrated, the interior of sleeve 680 merges with the interior of sleeve 650 at the forehead portion of the inner hood such that two drawstrings extend side-by-side in and share the same channel or tube along the front of inner hood 626. In other implementations, sleeve 680 comprises a tube separate and independent of the tube forming sleeve 650. Sleeve 680 guides and slidably receives constrictor 634 which is in the form of a drawstring 681.

Although illustrated as a continuous, uninterrupted sleeve, sleeve 680 may alternatively comprise a series of spaced sleeves along inner hood 626 and through which drawstring 681 extends. In some implementations, sleeve 680 extends about the person's head similar to a headband. Although sleeve 680 is illustrated as having a drawstring opening 683 at the rear of inner hood 626 as shown in FIG. 19A, in other implementations, sleeve 680 may extend beyond inner hood 626 to an opening formed in outer hood 624.

Figure 19A:
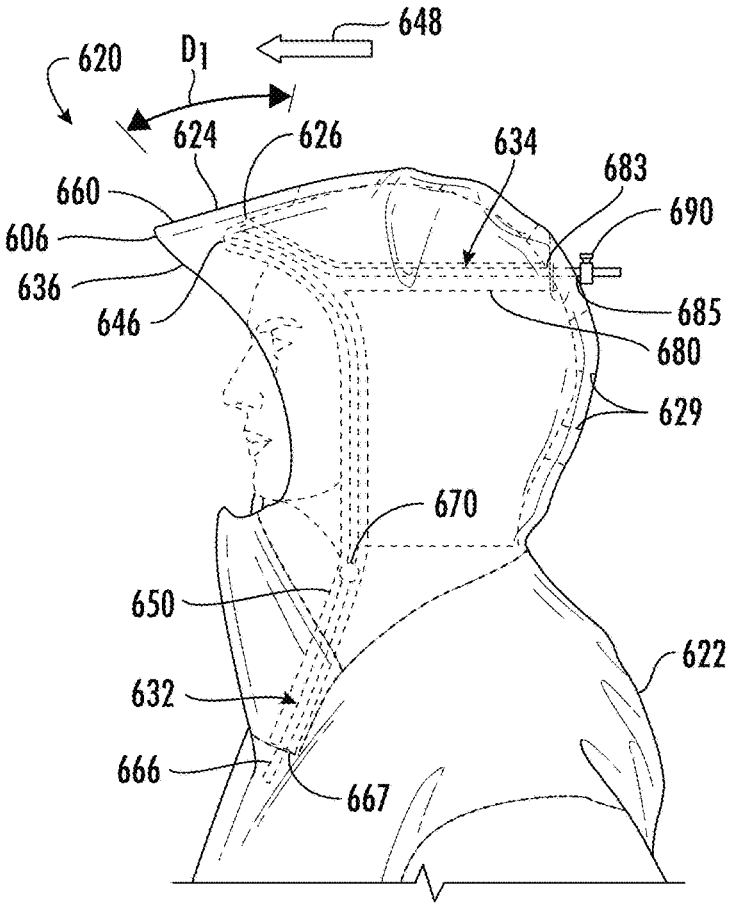
FIG. 19A is a side view of the example hooded garment of FIG. 16, illustrating both an example inner face opening constrictor and an example inner hood top constrictor in unconstricted states.

Drawstring 681 comprises an elongate, flexible band, rope, cord, string or the like which is threaded interior of sleeve 680, wherein opposite ends of drawstring 680 project through sleeve opening 683 and further through a rear outer hood opening 685 (shown in FIG. 19A). Drawstring 681 is slidably movable within and along sleeve 680.

In some implementations, the pulled or drawn state of the drawstrings 681 may be retained to better retain inner face opening 646 in the constricted state. For example, in some implementations, the opposite end portions of drawstring 681, those that project from opening 685, may be tied to one another. In the example illustrated, garment 620 additionally comprises a cord lock 690, such as a toggle spring cord lock, an ellipse toggle cord lock or a barrel toggle cord lock, wherein the opposite end portions of drawstring 681 pass through the cord lock 690 and are maintained in a selected pulled or drawn state to retain inner hood top constrictor 634 in the chosen constricted state. Release of the cord lock 690 may allow the inner hood top constrictor 634 to once again be unconstricted and expanded to facilitate removal of inner hood 626 (and outer hood 624) from the person's head or to provide greater air flow. Other than at the rear of the outer hood 624, such expansion or on constriction of inner hood top constrictor 634 does not correspondingly change the shape or size of outer hood 624 along its top or sides.

Figure 19B:
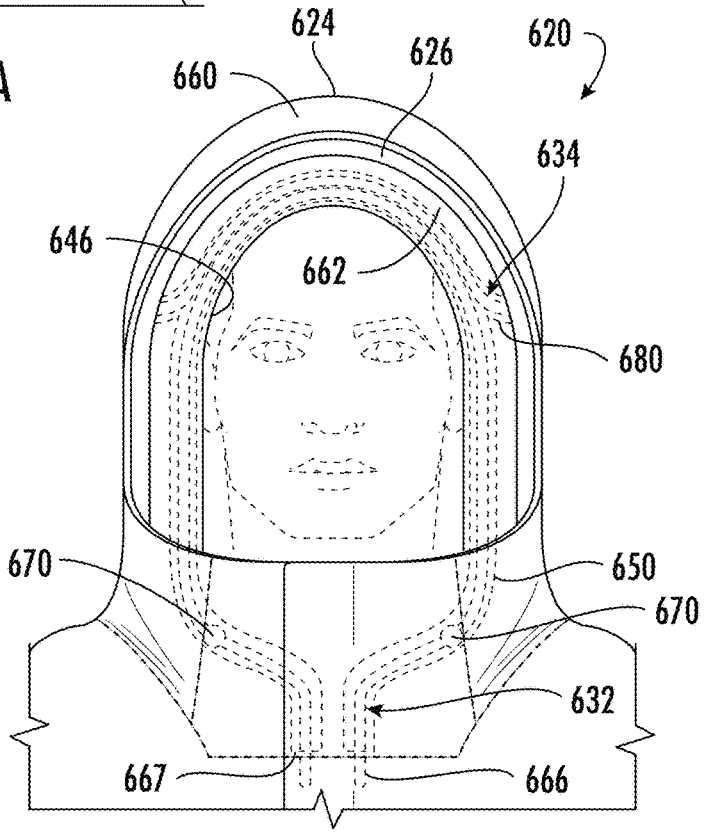
FIG. 19B is a front view of the example hooded garment of FIG. 19A.
Figure 20A:
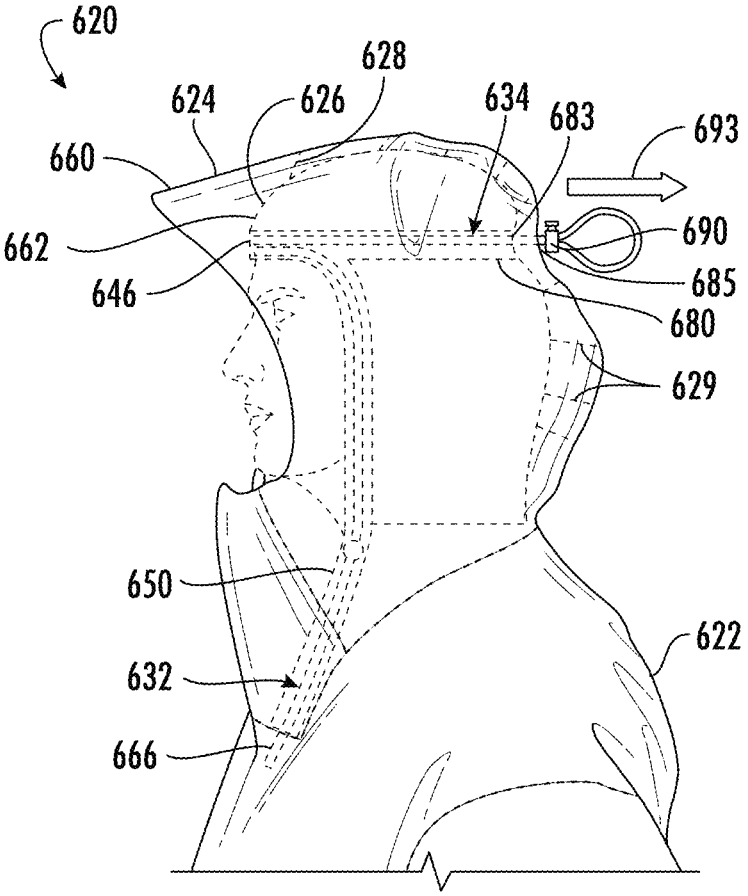
FIG. 20A is a side view of the example hooded garment of FIG. 16, illustrating the example inner face opening constrictor in an unconstructive state and an example inner hood top constrictor in a constricted state.
Figure 20B:
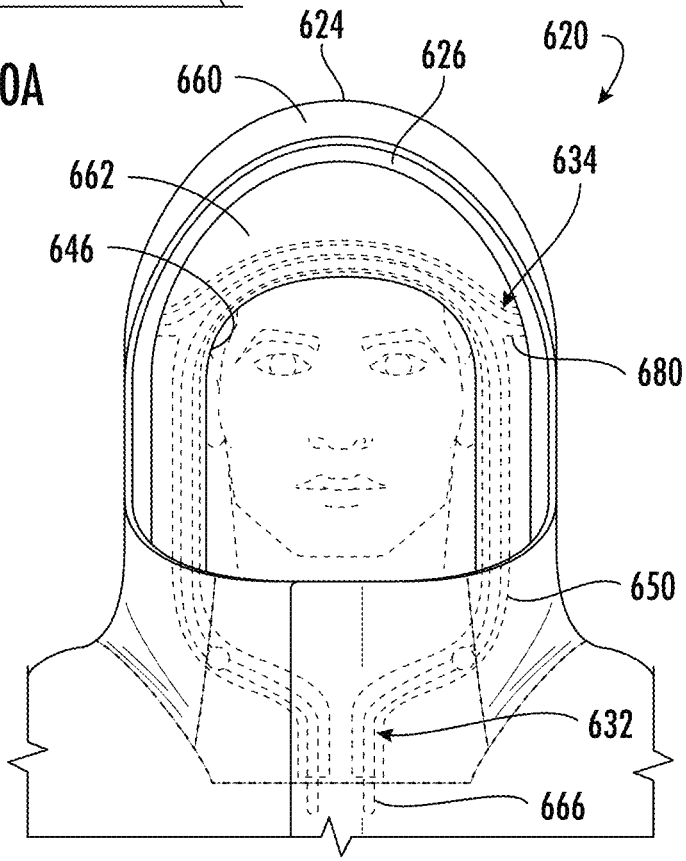
FIG. 20B is a front view of the example hooded garment of FIG. 20A.
Figure 21B:
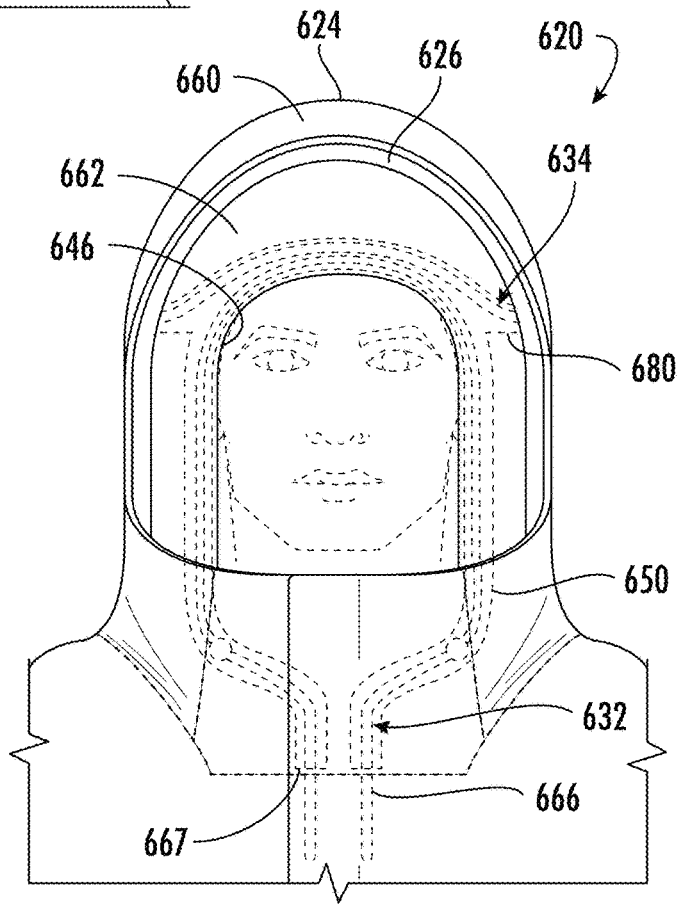
FIG. 21B is a front view of the example hooded garment of FIG. 20B.

FIGS. 19A and 19B illustrate both the inner face side opening constrictor 632 and the inner hood top constrictor 634 in an un-constricted state. As a result, the top and sides of the inner hood 626 may be spaced from the top and sides of the person's head, providing greater air flow therebetween. FIGS. 20A and 20B illustrate constriction of the inner hood top, as result of the drawstring 680 being rearwardly pulled through the cord lock 690 in the direction indicated by arrow 693. This occurs while the inner face side opening constrictor 632 remains unconstricted or in a lesser constricted state. As a result, the top portions of the inner hood are constricted against and about the top of the person's head while the sides may remain somewhat loose and spaced from the sides of the person's face to provide airflow. FIG. 20A further illustrates lead 628 located rearward the inner face opening 646 and extending between and connecting an exterior of the inner hood 626 and an interior of the outer hood 624 such that the lead 628 is connected to the interior of the outer hood 624 at a location that is higher than the uppermost edge of the inner face opening 646 when the inner hood 626 and the outer hood 624 extend over a head of a vertically oriented person wearing the hooded garment 620. As shown by FIG. 21A, lead 628 comprises a forwardly facing panel configured to have a lower portion connected to the exterior of the inner hood 626 and an upper portion, above the lower portion, connected to the interior of the outer hood 624 when the inner hood 626 and the outer hood 624 are positioned over a head of a vertically oriented person wearing the hooded garment 620. FIGS. 21A, 21B and 22 illustrate both the inner face opening constrictor 632 and the inner hood top constrictor 634 in a constricted state. As result, the inner hood 626 may more closely conform to the top and sides of the head of the person wearing garment 620, better retaining heat. At the same time, the outer hood 624 is substantially retained in shape and size to better block wind, sun, snow and/or rain. Garment 620 allows such constrictors 634, 636 to be independently constricted or unconstricted.

Figure 23:
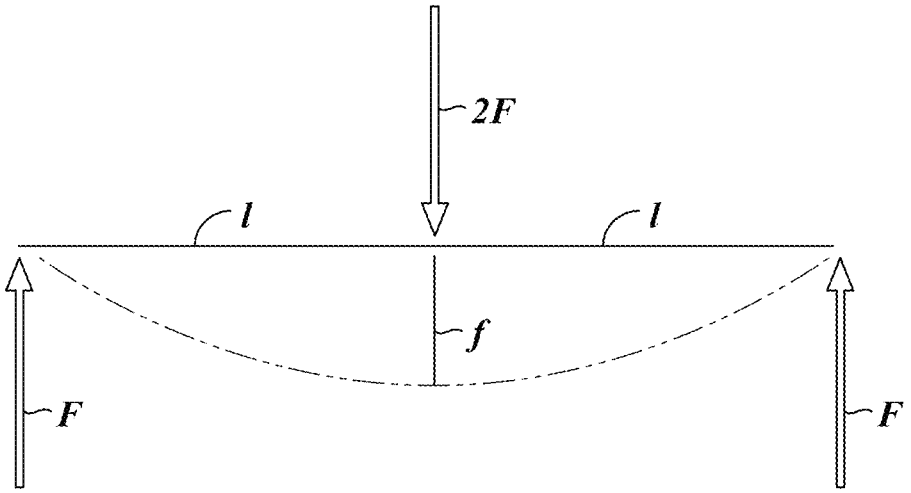
FIG. 23 is a diagram illustrating a 3-point bending stiffness test based on ISO Standard 5628.

Applicant measured the bending stiffness of the outer brim portion 60, 460, 660 and the inner brim portion 62, 462, 662. Applicant worked with Assurance Technologies, Inc. ("ATI") of Bartlett, Illinois, an accredited lab that provides calibration services, dimensional inspection services, and testing services, to measure the bending stiffness of the outer brim portion 60, 460, 660 and the inner brim portion 62, 462, 662 in accordance with International Standard No. ISO 5628:2019, "Determination of Bending Stiffness—General Principles for Two-point, Three-point and Four-point Methods". ATI utilized the three-point testing method of ISO 5628:2019, which is schematically illustrated in FIG. 23. ISO Standard 5628 provides test methods to enable the bending stiffness to be measured and described in a consistent way, despite variations in material type and instrument design. For low thickness specimens, the three-point bending test method is provided. ISO Standard 5628 defines bending stiffness as resistance that a test piece offers to bending, in the region of elastic deformation. FIG. 23 replicates FIG. 3 of ISO 5628:2019 in which a test piece is supported close to each end and is subjected to a force, 2F, in the center of the test piece and acting perpendicular to the surface of the test piece at the start of the test. The distance between the end support locations 2I, with I being the bending length. The linear deflection, f, of the test piece is the shift in the point of application of the force in the direction in which it acts. The bending stiffness, $S_b$, is calculated using the following formula. b is per unit sample thickness of the test piece (in the direction of the bending axis).

$$S_b=(F/f)\cdot(l^3/3b)$$

The bending stiffness, $S_b$, of 10 test pieces of the outer brim portion 460 and 10 test pieces of the inner brim portion 462 were measured using the three-point bending test method of ISO 5628:2019. The materials used to produce the outer brim portion 460 and the inner brim portion 462 were used to form test specimens having a length and a width of 102 mm. The linear deflection, f, was 15 mm and the bending length, I, was 38.1 mm. The sample thickness (b) of the samples of the outer brim portion 460 ranged from 0.84 mm to 0.97 mm, and the sample thickness (b) of the samples of the inner brim portion 462 ranged from 1.433 mm to 1.693 mm. The bending stiffness $S_b$ of the outer brim portion test specimens and the inner brim portion test specimens were measured and are listed in Table 1 below.

TABLE 1

BENDING STIFFNESS OF BRIM PORTIONS

| Sample | Sample No | Sample Thickness (b) mm | Force - (F) Newtons | Deflection (f) mm | Bending Length (l) mm | Bending Stiffness ($S_b$) N · mm |
|---|---|---|---|---|---|---|
| Inner Brim Portion | 1 | 0.85 | 0.59158 | 15 | 38.1 | 855.382 |
| | 2 | 0.85 | 0.70278 | 15 | 38.1 | 1016.17 |
| | 3 | 0.84 | 0.68499 | 15 | 38.1 | 1016.17 |
| | 4 | 0.88 | 0.69389 | 15 | 38.1 | 969.101 |
| | 5 | 0.86 | 0.70723 | 15 | 38.1 | 1016.17 |
| | 6 | 0.84 | 0.74284 | 15 | 38.1 | 1016.17 |
| | 7 | 0.85 | 0.72058 | 15 | 38.1 | 1016.17 |
| | 8 | 0.97 | 0.70278 | 15 | 38.1 | 969.101 |
| | 9 | 0.97 | 0.59158 | 15 | 38.1 | 749.561 |
| | 10 | 0.89 | 0.67165 | 15 | 38.1 | 927.5 |
| | Avg. | 0.88 | 0.74284 | | | 959.152 |
| | Range | 0.13 | 0.15123 | | | 324.489 |
| Outer Brim Portion | 1 | 1.532 | 0.11565 | 15 | 38.1 | 92.7773 |
| | 2 | 1.497 | 0.1201 | 15 | 38.1 | 98.5982 |
| | 3 | 1.433 | 0.13789 | 15 | 38.1 | 118.261 |
| | 4 | 1.45 | 0.16902 | 15 | 38.1 | 143.266 |
| | 5 | 1.565 | 0.15123 | 15 | 38.1 | 118.766 |
| | 6 | 1.692 | 0.15568 | 15 | 38.1 | 113.082 |
| | 7 | 1.489 | 0.13344 | 15 | 38.1 | 110.142 |
| | 8 | 1.525 | 0.11565 | 15 | 38.1 | 93.2032 |
| | 9 | 1.534 | 0.16013 | 15 | 38.1 | 128.293 |
| | 10 | 1.49 | 0.13789 | 15 | 38.1 | 113.737 |
| | Avg. | 1.5207 | 0.13967 | | | 113.013 |
| | Range | 0.259 | 0.05338 | | | 50.4886 |

The bending stiffness, $S_b$, results demonstrate that the outer brim portion had bending stiffness that is significantly greater than the bending stiffness of the inner brim portion. In particular, the bending stiffness $S_b$ of the samples of the outer brim portion was found to be at least 5 times greater than the bending stiffness Sb of the inner brim portion (5.23 times) when tested in accordance with ISO 5628:2019. Additionally, when the average bending stiffness $S_b$ value obtained from the 10 outer brim portion samples is compared to the average bending stiffness $S_b$ value obtained from the 10 inner brim portion samples, the average bending stiffness Sb of the outer brim portion was found to be over 8 times greater than the average bending stiffness $S_b$ of the inner brim portion (8.487 times).

Accordingly in some implementations, outer brim portion 460 has a bending stiffness $S_b$ value that is at least twice the bending stiffness $S_b$ value of inner brim portion 462. In some implementations, outer brim portion 460 has a bending stiffness $S_b$ value that is at least 3 times the bending stiffness $S_b$ value of inner brim portion 462. In some implementations, outer brim portion 460 has a bending stiffness $S_b$ value that is at least 5 times the bending stiffness $S_b$ value of inner brim portion 462. In other implementations, the outer brim portion 460 has a bending stiffness value that is at least 6 times the bending stiffness value of inner brim portion 462. In other implementations, the outer brim portion 460 has a bending stiffness value that is at least 7 times the bending stiffness value of inner brim portion 462. In still other implementations, the outer brim portion 460 has a bending stiffness value that is at least 8 times the bending stiffness value of inner brim portion 462. The values or degrees of bending stiffness and the relative difference in bending stiffness between outer hood 424 and inner hood 426 impact the ability of constrictor 432 to constrict inner brim portion 462 without correspondingly constricting outer brim portion 460. The hood thereby provides an inner brim portion that is readily constrictable and adjustable to meet the needs of the wearer while the outer brim portion is configured to generally retain its shape even in adverse weather conditions and when the wearer chooses to cinch, adjust and/or constrict the inner brim portion.

Although the present disclosure has been described with reference to example implementations, workers skilled in the art will recognize that changes may be made in form and detail without departing from the disclosure. For example, although different example implementations may have been described as including features providing various benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A hooded garment comprising:

a body portion;

an outer hood projecting from the body portion and having an outer face opening;

an inner hood projecting from the body portion within the outer hood, the inner hood having an inner face opening facing in a forward direction;

a lead rearward the inner face opening and extending between and connecting an exterior of the inner hood and an interior of the outer hood such that the lead is connected to the interior of the outer hood at a location that is higher than an uppermost edge of the inner face opening when the inner hood and the outer hood extend over a head of a vertically oriented wearer wearing the hooded garment; and an inner face opening constrictor connected to the inner hood to constrict the inner face opening without constricting the outer face opening.

2. The hooded garment of claim 1, wherein the inner face opening constrictor comprises:

a sleeve extending along the inner face opening forward of the lead; and a draw string slidably received within the sleeve, the draw string being pullable to constrict the inner face opening without constricting the outer face opening.

3. The hooded garment of claim 1, wherein the lead comprises a forwardly facing panel, the forwardly facing panel being configured to have a lower portion connected to the exterior of the inner hood and an upper portion, above the lower portion, connected to the interior of the outer hood when the inner hood and the outer hood are positioned over the head of the vertically oriented wearer wearing the hooded garment.

4. The hooded garment of claim 3, wherein the inner hood comprises an inner brim portion extending from the lead to a forward edge of the inner hood, the inner brim portion having a length of at least 1 inch, and wherein the outer hood comprises an outer brim portion having a length of at least 1.0 inch.

5. The hooded garment of claim 3, wherein the forwardly facing panel extends at least 180 degrees about and rearward the inner face opening.

6. The hooded garment of claim 5, wherein the inner hood comprises an inner brim portion having a first bending stiffness value and wherein the outer hood comprises an outer brim portion having a second bending stiffness value that is greater than the first bending stiffness value.

7. The hooded garment of claim 6, wherein the second bending stiffness value is at least two times greater than the first bending stiffness value.

8. The hooded garment of claim 6, wherein the second bending stiffness value is at least five times greater than the first bending stiffness value.

9. The hooded garment of claim 6, wherein the second bending stiffness value is at least eight times greater than the first bending stiffness value.

10. The hooded garment of claim 6, wherein the outer hood has a sufficient bending stiffness to retain a shape and size of the outer hood as the inner face opening is being constricted.

11. The hooded garment of claim 10, wherein the inner brim portion and the lead have a combined length within the range of 1.0 to 5.0 inches, and wherein the outer brim portion has a length within the range of 0.5 to 6 inches.

12. The hooded garment of claim 10, wherein the inner brim portion and the lead have a combined length that is equal to or less than the length of the outer brim portion.

13. The hooded garment of claim 1, wherein the inner hood comprises an insulation layer and wherein the outer hood omits any insulation layer.

14. The hooded garment of claim 1, wherein the body portion has a back region and wherein a single continuous panel of material forms the outer hood and the back region of the body portion, and wherein a second continuous panel of material forms the inner hood and the back region of the body portion.

15. The hooded garment of claim 1, wherein the outer hood comprises a generally rigid sculptural exterior hood and wherein the inner hood comprises a down-filled hood.

16. The hooded garment of claim 1, wherein the inner hood comprises an inner brim portion extending forwardly from the lead and having a first bending stiffness, and wherein the outer hood comprises an outer brim portion extending forwardly from the lead and having a second bending stiffness greater than the first bending stiffness.

17. The hooded garment of claim 1 further comprising an inner hood top constrictor connected to the inner hood to constrict the inner hood about a top of the head of the wearer wearing the hooded garment.

18. The hooded garment of claim 17, wherein the inner face opening constrictor and the inner hood top constrictor can be adjusted independently by the wearer of the garment.

19. The hooded garment of claim 1, wherein the lead comprises at least one panel, the lead extending along a majority of the inner face opening rearward of the inner face opening.

20. A hooded garment comprising:

a body portion;

an outer hood projecting from the body portion and having an outer face opening;

an inner hood projecting from the body portion within the outer hood, the inner hood having an inner face opening facing in a forward direction;

a lead rearward the inner face opening and extending between and connecting an exterior of the inner hood and an interior of the outer hood such that the lead is connected to the interior of the outer hood at a location that is higher than an uppermost edge of the inner face opening when the inner hood and the outer hood extend over a head of a vertically oriented wearer wearing the hooded garment; and an inner face opening constrictor connected to the inner hood to constrict the inner face opening without constricting the outer face opening, wherein the lead comprises a forwardly facing panel and wherein the forwardly facing panel extends at least 180 degrees about and rearward the inner face opening.

21. The hooded garment of claim 20, wherein the inner hood comprises an inner brim portion having a first bending stiffness value and wherein the outer hood comprises an outer brim portion having a second bending stiffness value that is greater than the first bending stiffness value.

* * * * *